US009902585B2

(12) United States Patent
Hayashi

(10) Patent No.: US 9,902,585 B2
(45) Date of Patent: Feb. 27, 2018

(54) STACKING APPARATUS, RECORDING APPARATUS AND STACKING METHOD

(71) Applicant: Seiko Epson Corporation, Tokyo (JP)

(72) Inventor: Toshihiro Hayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/229,572

(22) Filed: Aug. 5, 2016

(65) Prior Publication Data

US 2017/0050451 A1 Feb. 23, 2017

(30) Foreign Application Priority Data

Aug. 19, 2015 (JP) ..... 2015-161675

(51) Int. Cl.

*B65H 20/30* (2006.01)
*B65H 31/26* (2006.01)
*B41J 13/10* (2006.01)

(52) U.S. Cl.

CPC ..... *B65H 20/30* (2013.01); *B41J 13/106* (2013.01); *B65H 31/26* (2013.01); *B65H 2301/4215* (2013.01); *B65H 2701/11312* (2013.01)

(58) Field of Classification Search

CPC ..... B65H 31/00; B65H 31/26; B65H 2701/11312; B41J 13/106

See application file for complete search history.

(56) References Cited

U.S. PATENT DOCUMENTS 3,704,884 A * 12/1972 Nicolay ..... B65H 29/246 112/470.36
3,712,609 A * 1/1973 Robert ..... A41H 43/0221 112/470.36
5,207,417 A * 5/1993 Bell ..... B65H 29/40 271/175
5,440,958 A 8/1995 Terasaki et al.
8,387,973 B1 * 3/2013 Fernandez ..... B26D 5/00 271/175
2009/0127770 A1 * 5/2009 Tamaki ..... B65H 31/02 271/207

FOREIGN PATENT DOCUMENTS

JP 06234453 A * 8/1994
JP 06-255869 A 9/1994
JP 06293461 A * 10/1994

* cited by examiner

*Primary Examiner* — Luis A Gonzalez
(74) *Attorney, Agent, or Firm* — Workman Nydegger

(57) ABSTRACT

A stacking apparatus is provided with a stacking member that stacks a sheet as a recording medium that is discharged from a recording apparatus such that the sheet hangs on the stacking member, a guiding part that guides the sheet down to a point lower than a top of the stacking member, and an urging unit that controls movement of the sheet.

14 Claims, 17 Drawing Sheets

STACKING APPARATUS, RECORDING APPARATUS AND STACKING METHOD

BACKGROUND

1. Technical Field

The present invention relates to a stacking apparatus, a recording apparatus and a stacking method.

2. Related Art

Some recording apparatuses, such as a printer or the like, are provided with a stacking apparatus that holds a printed recording medium discharged from the recording apparatus. For example, a stacking apparatus disclosed in JP-A-6-255869 is provided with sheet guiding means for guiding a sheet (recording medium) which is discharged from a sheet discharging unit toward one side of sheet supporting means and direction changing means for changing a direction of the discharged sheet toward the other side of the sheet supporting means. Hence, according to JP-A-6-255869, the sheet that has been discharged from an image output apparatus (recording apparatus) can be held while hanging down on the sheet supporting means.

The stacking apparatus according to JP-A-6-255869 is configured to include a sheet guiding plate as the sheet guiding means that protrudes from the sheet discharging unit of the recording apparatus and a rotating rod as the direction changing means that is mounted at an outer side of the sheet guiding plate. The use of such a component protruding from the apparatus or a component with a large moveable range makes the structure of the stacking apparatus in JP-A-6-255869 large.

SUMMARY

The invention can be realized in the following aspects or application examples.

Application Example 1

According to an aspect of the invention, there is provided a stacking apparatus that includes: a stacking member that stacks a recording medium discharged from a recording apparatus such that the recording medium hangs on the stacking member; a guiding part that is a part of the stacking member and guides the recording medium down to a point lower than the top of the stacking member; and an urging unit that controls movement of the recording medium.

According to this application example, the stacking apparatus includes the guiding part that guides the recording medium discharged from the recording apparatus downward in one direction from the top of the stacking member which stacks the recording medium such that the recording medium hangs on the stacking member. Once the downward movement of the recording medium, which moves along the guiding part, is controlled by the urging unit disposed at the side of the urging unit, the recording medium that is being discharged from the recording apparatus is then guided downward along the guiding part at the other side of the urging unit. The recording medium that has been completely discharged from the recording apparatus is held in a state where the recording medium hangs on the stacking member with the both ends thereof are hung at respective sides of the stacking member. Since the stacking apparatus can be realized with such a simple configuration having the stacking member and the urging unit that stops the movement of the recording medium moving along the guiding part of the stacking member, it is possible to make the stacking apparatus smaller. Accordingly, it is possible to provide a smaller stacking apparatus.

Application Example 2

In the stacking apparatus according to the above aspect of the invention, it is preferable that the guiding part guide the recording medium toward the recording apparatus.

In this application example, the recording medium is guided toward the recording apparatus by the guiding part. As a result, it becomes possible to mount the urging unit that controls the movement of the recording medium at the place between the guiding part and the recording apparatus. Accordingly, the size of the entire apparatus including the stacking apparatus and the recording apparatus can be made smaller.

Application Example 3

In the stacking apparatus according to the above application example, it is preferable that the stacking member has a convex shape with the top at a center.

According to this application example, when the recording medium is stacked on the stacking member, it is possible to ease a tendency for the stacked recording medium to be folded by the weight thereof since the stacking member has a convex shape with the top at a center.

Application Example 4

In the stacking apparatus according to the above application example, it is preferable that the urging unit control the movement of the recording medium by pressing the recording medium against the guiding part.

According to this application example, the urging unit presses, against the guiding part, the recording medium that moves downward along the guiding part. Since the recording medium moves in a state of being in contact with the guiding part, the urging unit that stops the movement can be configured with a component with a small moveable range. Hence it is possible to make a smaller stacking apparatus.

Application Example 5

In the stacking apparatus according to the above application example, it is preferable that the urging unit press the recording medium against the guiding part at a position lower than the top of the stacking member.

According to this application example, the urging unit presses the recording medium against the guiding part at the position lower than the top of the stacking member. When the urging unit has a structure in which the urging unit presses the recording medium at the top of the stacking member, a component of the urging unit needs a large moveable range and, as a result, the stacking apparatus becomes large. However, when the urging unit has a structure in which the urging unit presses the recording medium against the guiding part at a position lower than the top of the stacking member, a component of the urging unit does not need a large moveable range, and thereby it is possible to make a smaller stacking apparatus.

Application Example 6

According to this application example, there is provided a recording apparatus that includes the stacking apparatus of any one of Application Examples 1 to 5.

According to this application example, since the recording apparatus includes a small stacking apparatus, it is possible to provide a small recording apparatus.

Application Example 7

According to this application example, there is provided a stacking method that is performed by a stacking apparatus including a stacking member that stacks a recording medium discharged from a recording apparatus such that the recording medium hangs on the stacking member, a guiding part that is a part of the stacking member and guides the recording medium down to a point lower than the top of the stacking member, and an urging unit that controls movement of the recording medium. The stacking method includes: guiding the recording medium down to the point lower than the top of the stacking member; and controlling the movement of the recording medium. In the guiding of the recording medium, the recording medium is guided toward the recording apparatus, and in the controlling of the movement of the recording medium, the recording medium is guided away from the recording apparatus.

According to this application example, the stacking method performed by a stacking apparatus includes guiding the recording medium down to the point lower than the top of the stacking member that stacks the recording medium discharged from a recording apparatus such that the recording medium hangs on the stacking member, and controlling the movement of the recording medium. The recording medium is guided toward the recording apparatus along the guiding part in the guiding of the recording medium. Once the movement of the recording medium is controlled in the controlling of the movement, the recording medium that is being discharged from the recording apparatus is guided away from the recording apparatus. Accordingly the recording medium that has been completely discharged from the recording apparatus is held in the state where the recording medium hangs on the stacking member in the both ends thereof are hung at respective sides of the stacking member. Since the stacking method allows the stacking apparatus to be realized with a simple configuration in which the stacking member and the urging unit that stops the movement of the recording medium which moves along the guiding part which is a part of the stacking member are included, it is possible to make a smaller stacking apparatus. Therefore, it is possible to provide a stacking method that allows a stacking apparatus to be downsized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the drawings. Since each of the following drawings illustrates each layer and member in recognizable sizes, the actual sizes of each layer and member are different from the sizes in the following drawings.

In FIGS. 1 to 3, FIGS. 6 to 11, and FIG. 15, for convenience of explanation, three axes, the x-axis, the y-axis and the z-axis, which are orthogonal to each other, are illustrated. The front ends of the arrows indicate a "positive direction" and the rear ends indicate a "negative direction". A direction parallel to the x-axis will be referred to as an "x-axis direction", a direction parallel to the y-axis will be referred to as a "y-axis direction", and a direction parallel to the z-axis will be referred to as a "z-axis direction".

First Embodiment

Figure 1:
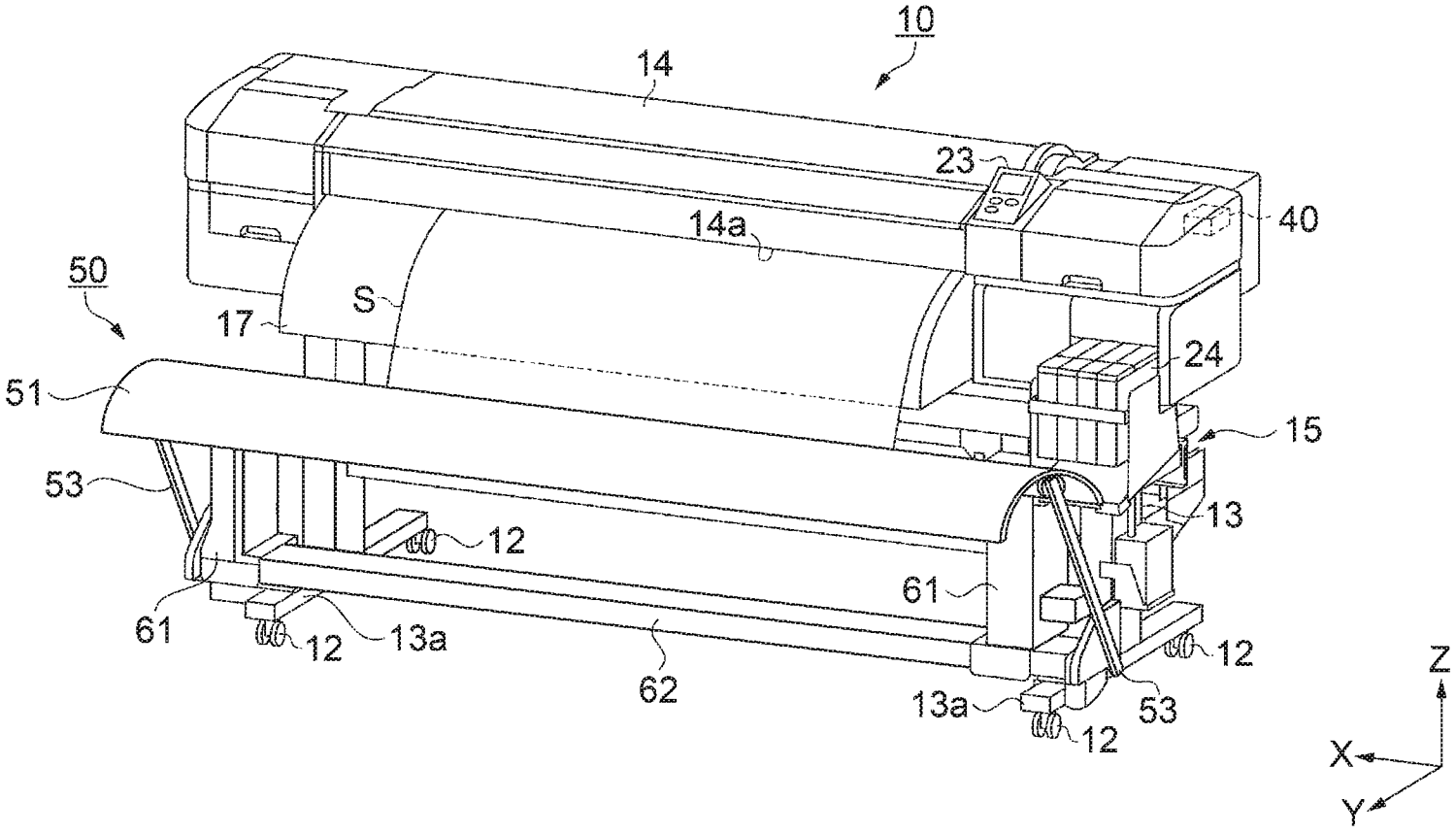
FIG. 1 is a schematic diagram illustrating a schematic configuration of a stacking apparatus and a recording apparatus that discharges a recording medium to the stacking apparatus according to a first embodiment.
Figure 2:
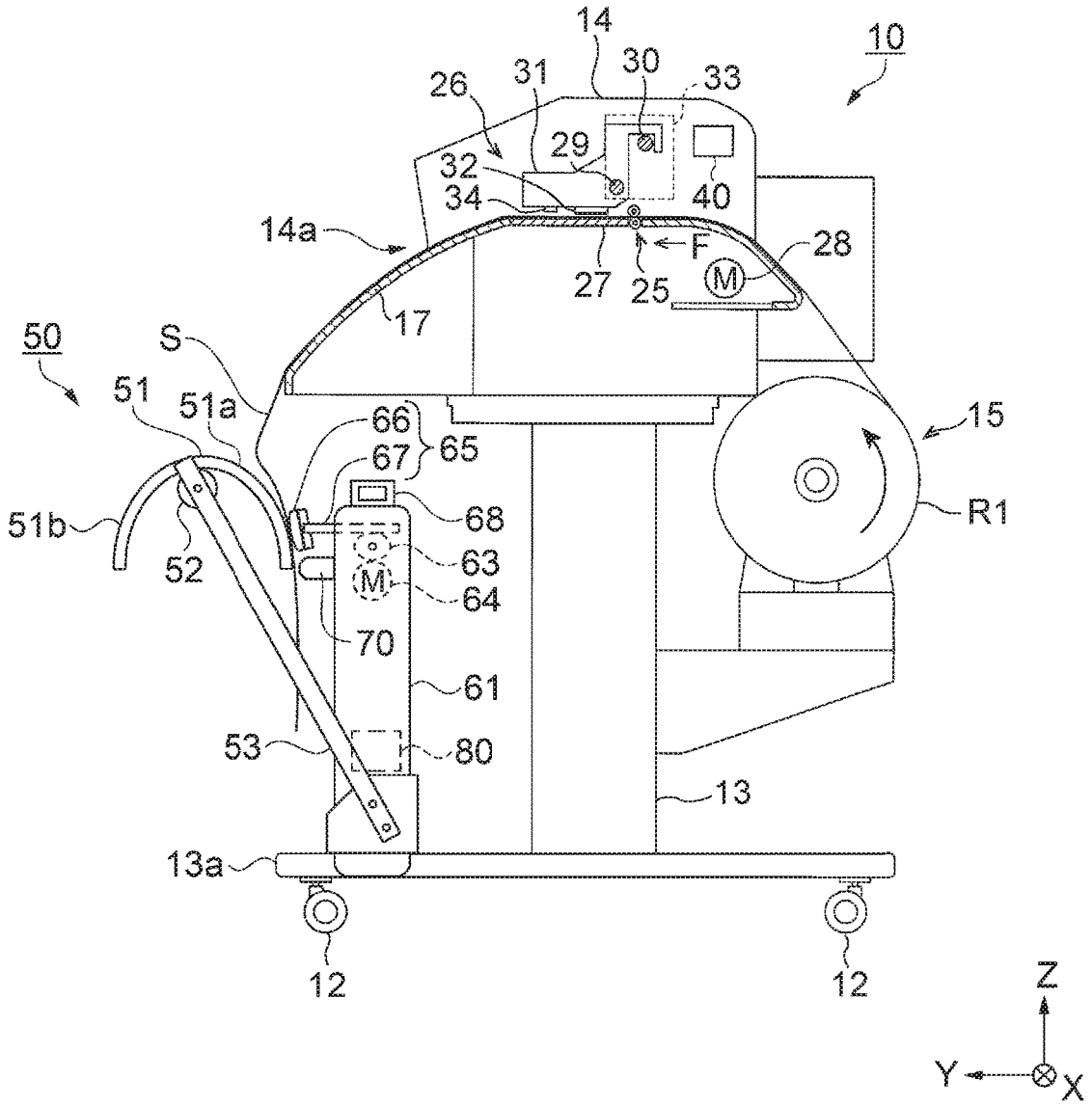
FIG. 2 is a side view of the stacking apparatus and the recording apparatus.

FIG. 1 is a schematic diagram illustrating a schematic configuration of a stacking apparatus and a recording apparatus that discharges a recording medium to the stacking apparatus according to a first embodiment. FIG. 2 is a side view of the stacking apparatus and the recording apparatus. First, a schematic configuration of a stacking apparatus 50, and a schematic configuration of a recording apparatus 10 that discharges a recording medium to the stacking apparatus 50 according to the embodiment will be described.

Schematic Configuration of Recording Apparatus

As shown in FIGS. 1 and 2, the recording apparatus 10 is a large format printer (LFP) that records an image or the like onto a long sheet S which is an example of the recording medium. Other recording media, including various types of paper, fabric, and film, can be used as well. In the embodiment, a recording apparatus, having a configuration in which the long sheet S in a roll is supplied, is described as an example of the recording apparatus. However, the recording apparatus is not limited thereto. For example, a recording apparatus having a configuration in which a sheet cut in a predetermined length in advance is supplied in a single-sheet feeding system may be used.

The recording apparatus 10 is provided with a pair of legs 13 of which wheels 12 for moving the recording apparatus 10 are attached at lower ends, and a recording unit housing 14 that is assembled on the legs 13, or the like. In the embodiment, an up-and-down direction along the direction of gravity will be represented by the z-axis and the positive direction of the z-axis will be referred to as "upward". A longitudinal direction (width direction) of the recording unit housing 14 that crosses (in the embodiment, is orthogonal to) the z-axis will be represented by the x-axis and the positive direction of the x-axis will be referred to as "left". A direction that crosses (in the embodiment, is orthogonal to) both of the z-axis and the x-axis (a front-and-rear direction) is represented by the y-axis and the positive direction of the y-axis will be referred to as "front".

In the recording unit housing 14, a controller 40 that controls an operation of the recording apparatus 10 is provided. An operation panel 23 for a setting operation and an input operation is also provided on the upper right end of the recording unit housing 14. The operation panel 23 is electrically connected to the controller 40.

Under the recording unit housing 14, liquid containers 24 capable of containing ink are provided on a right end side, that is, an outer side of a transporting path of the sheet S in a width direction (x-axis direction). A plurality of liquid containers 24 are provided depending on the number of different types or colors of ink. In the embodiment, there are four liquid containers 24 that contain four different colors of ink (for example, cyan: C, magenta: M, yellow: Y, and black: K).

Under the rear side of the recording unit housing 14, a feeder 15 that is supported by the legs 13 and feeds the sheet S toward the recording unit housing 14 is disposed. In the recording unit housing 14, a medium guiding member 17 is provided along the transporting path of the sheet S.

A roller R1 around which an unused sheet S is wound in a roll is held in the feeder 15. In the feeder 15, the roller R1 is loaded in a manner in which the roller R1 can be replaced by rollers R1 of different sizes in which the width (length in the x-axis direction) of the sheet S or the number of times the sheet S being wound is different. The roller R1 of any size is loaded in the feeder 15 in a state where the roller R1 leans against the right end in the x-axis direction (the negative direction of the x-axis). Once the feeder 15 rotates the roller R1 counterclockwise in FIG. 2, the sheet S is fed into the recording unit housing 14 along the medium guiding member 17 after being unwound from the roller R1.

The front end of the medium guiding member 17 protrudes from the recording unit housing 14 toward the front and the rear end of the medium guiding member 17 is housed in the recording unit housing 14. On the front side of the recording unit housing 14 and above the medium guiding member 17, a discharging port 14*a* for discharging the sheet S from the recording unit housing 14 is provided.

In the recording unit housing 14, a pair of transporting rollers 25 that transports the sheet S in a transporting direction F and a transporting motor 28 that supplies rotary power to the pair of transporting rollers 25 are provided. The recording unit housing 14 also houses a recording unit 26 that is provided on the downstream side of the transporting rollers 25 in the transporting direction F and implements printing (recording) onto the transported sheet S. In addition, a medium supporting unit 27 that is a part of the medium guiding member 17 and that supports the sheet S is provided at a position facing the recording unit 26 with the sheet S being placed between the recording unit 26 and the medium supporting unit 27.

In the recording unit 26, there are guide shafts 29 and 30 that are provided to extend in the width direction (x-axis direction), a carriage 31 that is supported by the guide shafts 29 and 30, and a liquid ejection unit 32 that is held under the bottom of the carriage 31. The carriage 31 reciprocates, along the guide shafts 29 and 30, within a movement region which extends in a main scanning direction (x-axis direction) that crosses the transporting direction F of the sheet S.

At both ends of the guide shafts 29 and 30 in the main scanning direction (x-axis direction), there is provided a regulating mechanism 33 that changes a height of the liquid ejection unit 32 (a position in the z-axis direction) to regulate a distance between the liquid ejection unit 32 and the sheet S. A reflective sensor 34 as a paper width sensor is held at a position on the downstream side of the liquid ejection unit 32 in the transporting direction F under the bottom of the carriage 31.

The reflective sensor 34 is an optical sensor provided with a light source unit and a light receiving unit (not shown). The light receiving unit receives reflected light obtained by light being emitted downward from the light source unit, and a detected value V (voltage value) that varies depending on the intensity of the reflected light received by the light receiving unit is output to the controller 40. The controller 40 calculates a width (length in the x-axis direction) of the sheet S based on the detected value V while the reflective sensor 34 moves the carriage 31 in the main scanning direction to detect a changing position of an object from which light is reflected, that is, a position of both ends of the sheet S in the width direction (x-axis direction).

In accordance with the detected width of the sheet S, the liquid ejection unit 32 moves along with the carriage 31 in the main scanning direction and ejects ink supplied from the liquid container 24 onto the sheet S transported along the transporting path, thereby implementing the recording (printing) of an image or the like on the sheet S. After a cutter (not shown) cuts the sheet S on which printing has been completed in a predetermined size (length in the y-axis), the sheet S is discharged from the discharging port 14*a* to the stacking apparatus 50 which will be described later.

In the embodiment, as the liquid ejection unit 32, a serial head type that is mounted in a movable carriage 31 and ejects ink while moving in the width direction of the sheet S (x-axis direction) has been described but a line head type, in which the liquid ejection unit 32 that is mounted over the entire sheet S (x-axis direction) in the width direction, may be used.

Schematic Configuration of Stacking Apparatus

Hereinafter, a schematic configuration of the stacking apparatus 50 will be described. The stacking apparatus 50 according to the embodiment is configured to be a separate apparatus from the recording apparatus 10. The stacking apparatus 50 is mounted at a side of the discharging port 14*a* from which the sheet S is discharged from the recording apparatus 10. In addition, the stacking apparatus 50 holds the sheet S on which an image or the like is recorded by the recording apparatus 10.

As illustrated in FIGS. 1 and 2, the stacking apparatus 50 includes a pair of stacking unit housings 61 and a beam 62 that connects the pair of stacking unit housings 61. The legs 13 of the recording apparatus 10 include horizontal legs 13*a* that extend in the y-axis direction and the stacking apparatus 50 is mounted on the pair of horizontal legs 13*a*. In one of the stacking unit housings 61, a controller 80 that controls an operation of the stacking apparatus 50 is provided. In addition, on top of the one of the stacking unit housings 61, an operation panel 68 for a setting operation and an input operation is provided. The operation panel 68 is electrically connected to the controller 80.

The stacking apparatus 50 includes a stacking member 51 that guides the sheet S as the recording medium which is discharged from the recording apparatus 10 to a point lower than the top of the stacking member 51 to stack the sheet S such that the sheet S hangs down thereon, a guide supporting unit 52 that supports the stacking member 51 and an urging unit 65 that controls the movement of the sheet S.

The guide supporting unit 52 is supported by tips of a pair of arm members 53 that extend from the pair of stacking unit housings 61. The guide supporting unit 52 has a width larger than the maximum width of the sheet S, in the x-axis direction, which can be used for the recording apparatus 10. The guide supporting unit 52 is at a position lower than and in front of the medium guiding member 17 that extends towards the front (positive direction of the y-axis) from the recording unit housing 14 of the recording apparatus 10.

The stacking member 51 includes guiding parts 51*a* and 51*b* that are integrated with each other. The guiding part 51*a* is shaped to guide the sheet S that has been discharged from the recording apparatus 10 in a direction approaching the recording apparatus 10. The guiding part 51*b* is in a shape symmetrical with the guiding part 51*a* with respect to the guide supporting unit 52 when seen from a side in the x-axis direction. The width of the stacking member 51 in the x-axis direction is larger than the maximum width of the sheet S used for the recording apparatus 10 and the length of the stacking member 51 along its shape in the y-axis direction is larger than the minimum length of the sheet S that is discharged from the recording apparatus 10. The stacking member 51 is provided so as to cover the guide supporting unit 52. In the embodiment, described is a configuration where the stacking member 51 in which the guiding parts 51*a* and 51*b* are integrated with each other covers the guide supporting unit 52. Instead, a configuration in which guiding parts 51*a* and 51*b* are formed separately and extend from the guide supporting unit 52 may be adopted. A configuration without the guiding part 51*b* being provided may be adopted as well.

In the embodiment, the stacking member 51 curves so as to be convexed upward to peak at the guide supporting unit 52 when seen from the side in the x-axis direction. Specifically, the stacking member 51 is shaped in an inverted catenary such that a sheet S with the smallest length in the y-axis direction and the highest rigidity, among the sheets S that can be discharged from the recording apparatus 10, is held at a position where the center line of the inverted catenary divides the inverted catenary into two halves in the y-axis direction, or is shaped in a slighter curve than such an inverted catenary. Therefore, it is unlikely for the sheet S to come off of a holding surface of the stacking member 51 when the stacking member 51 holds the sheet S, and it is possible to stack and hold a sheet S with a high rigidity and a small length since the sheet S is held in a stable manner. It is also possible to ease a tendency for the sheet S to be folded by the weight thereof since the sheet S is held to hang down on the stacking member 51. In addition, a tendency for the sheet S to curl after being wound in a roll can be corrected as well.

The urging unit 65 includes a pad 66 that is held by a pad holding portion and a lifting lever 67 that lifts the pad 66. The pad 66 is in a rectangular shape that extends in the x-axis direction and a width thereof in a longitudinal direction (the x-axis direction) is larger than the maximum width of the sheet S used for the recording apparatus 10 and is equal to the width of the stacking member 51. The pad 66 is formed of a material, for example, which has high surface friction, is less likely to be affected by compressive residual stress and absorbs shock well.

One end of the lifting lever 67 is connected to the pad holding portion and the other end is connected to the stacking unit housing 61. Between the one end and the other end of the lifting lever 67, a cam 63 is provided. Once a lifting motor 64 rotates the cam 63, the lifting lever 67 lifts the pad holding portion connected to the one end of the lifting lever 67 and the pad 66 held by the pad holding portion such that the pad holding portion and the pad 66 pivot around the other end of the lifting lever 67 as a fulcrum.

The urging unit 65 controls the movement of the sheet S by pressing the sheet S as the recording medium against the guiding part 51*a* that is a part of the stacking member 51. The urging unit 65 presses, at a position lower than the top of the stacking member 51, the sheet S as the recording medium against the guiding part 51*a*. In other words, the urging unit 65 is provided at a position where the pad 66 comes into contact with the guiding part 51*a* at a position near a lower end of the guiding part 51*a* and lower than the top of the stacking member 51 when the lifting lever 67 is lowered. The pad 66 of the urging unit 65 presses the sheet S against the guiding part 51*a* from the rear surface on which an image is not recorded such that a wide contact area of the sheet S over the entire width thereof is pressed when the lifting lever 67 is lowered. Accordingly, it becomes possible to reduce damage to the image resulting from being pressed against the guiding part 51*a* since friction required to control the movement of the sheet S is distributed.

Once the sheet S is discharged from the recording apparatus 10 in a state where the lifting lever 67 has been raised, the sheet S is guided in the direction approaching the recording apparatus 10 along the guiding part 51*a* of the stacking member 51 and is moved downward between the guiding part 51*a* and the pad 66. Once the lifting lever 67 is lowered, the sheet S that has been moved along the guiding part 51*a* is pressed against the guiding part 51*a* by the pad 66, thereby controlling the movement of the sheet. In a case where an urging unit that presses the sheet S against the top of the stacking member 51 is provided, it is required to use a component with a large moveable range. However, since the urging unit 65 in the embodiment presses the sheet S against the guiding part 51*a* at a position lower than the top of the stacking member 51, it is possible to configure the urging unit 65 with a component with a small movable range. Accordingly, it is possible to configure a small stacking apparatus 50. Since the stacking apparatus 50 includes the guiding part 51*a* that guides the sheet S in the direction approaching the recording apparatus 10, it is possible to provide the urging unit 65 between the guiding part 51*a* and the recording apparatus 10. As a result, the size of the entire apparatus can be made smaller when the stacking apparatus 50 is provided in the recording apparatus 10.

The stacking apparatus 50 includes a movement amount-detecting sensor 70 that detects a movement amount of the sheet S. The movement amount-detecting sensor 70 acquires the movement amount of the sheet S by imaging a surface of the sheet S that is discharged from the recording apparatus 10 and is moved downward along the guiding part 51*a* at predetermined time intervals and by comparing consecutive pieces of image data in a time series. The movement amount-detecting sensor 70 is provided at a position facing the guiding part 51*a* with the sheet S being placed therebetween.

Figure 3:
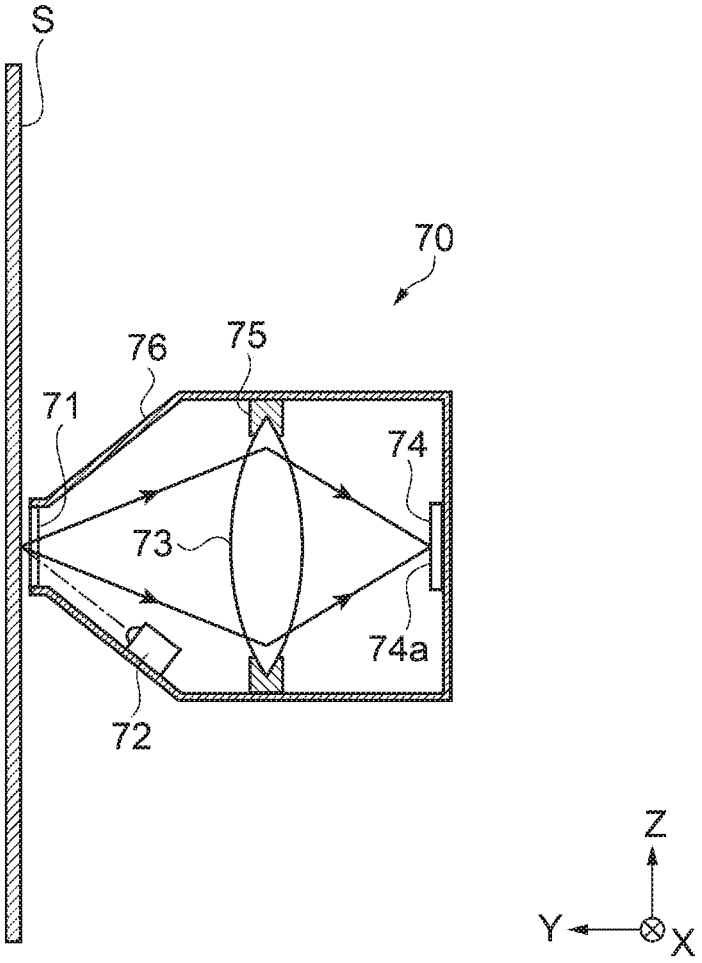
FIG. 3 is a sectional view illustrating a configuration of a movement amount-detecting sensor.

FIG. 3 is a sectional view illustrating a configuration of a movement amount-detecting sensor. As illustrated in FIG. 3, the movement amount-detecting sensor 70 includes a light emitting unit 72, a condenser 73, an imaging element 74 or the like inside a case 76.

The case 76 is an exterior structure of the movement amount-detecting sensor 70. The case 76 is in a shape of a cylinder with a truncated cone on top and a tip of the case 76 (an upper end) is attached to a translucent glass 71. The translucent glass 71 faces a surface of the sheet S in a state where clearance is provided between the translucent glass 71 and the sheet S in the y-axis direction.

The light emitting unit 72 emits light toward the sheet S. The light emitting unit 72 is provided on an inner wall of the case 76 and at an angle that allows the light emitting unit 72 to emit light toward the translucent glass 71. A light emitting diode (LED) or the like can be used as the light emitting unit 72, for example.

Once the light emitted from the light emitting unit 72 is transmitted through the translucent glass 71 and is reflected from a surface of the sheet S, the light is transmitted back through the translucent glass 71 and is incident to the inside of the case 76. Then the condenser 73, provided in a cylindrical portion of the case 76, converges this reflected light.

The imaging element 74 captures an image of a surface of the sheet S converged by the condenser 73 and includes an imaging surface 74*a* at a position where the image is formed. The imaging element 74 is provided on an inner bottom surface of the case 76. A holding member 75 holds the condenser 73 at a height that allows the image of the surface of the sheet S to be formed on the imaging surface 74*a* of the imaging element 74.

The movement amount-detecting sensor 70 outputs image data captured by the imaging element 74 to the controller 80. The controller 80 acquires a total movement amount of the sheet S by comparing consecutive pieces of image data in a time series, captured at predetermined time intervals, and by integrating the movement amount of the sheet S for each predetermined time interval.

It is preferable for the movement amount-detecting sensor 70 to maintain a certain distance to the sheet in order to focus on the image that is the surface of the sheet S when capturing the image. Accordingly, the position of the movement amount-detecting sensor 70 may be adjusted depending on the thickness of the sheet S or the number of the sheets S being stacked on the stacking member 51. Instead, the movement amount-detecting sensor 70 may be configured to allow focus adjustment, adjusting focus depending on the thickness of the sheet S or the number of the sheets S being stacked on the stacking member 51.

Electrical Configuration of Stacking Apparatus

Figure 4:
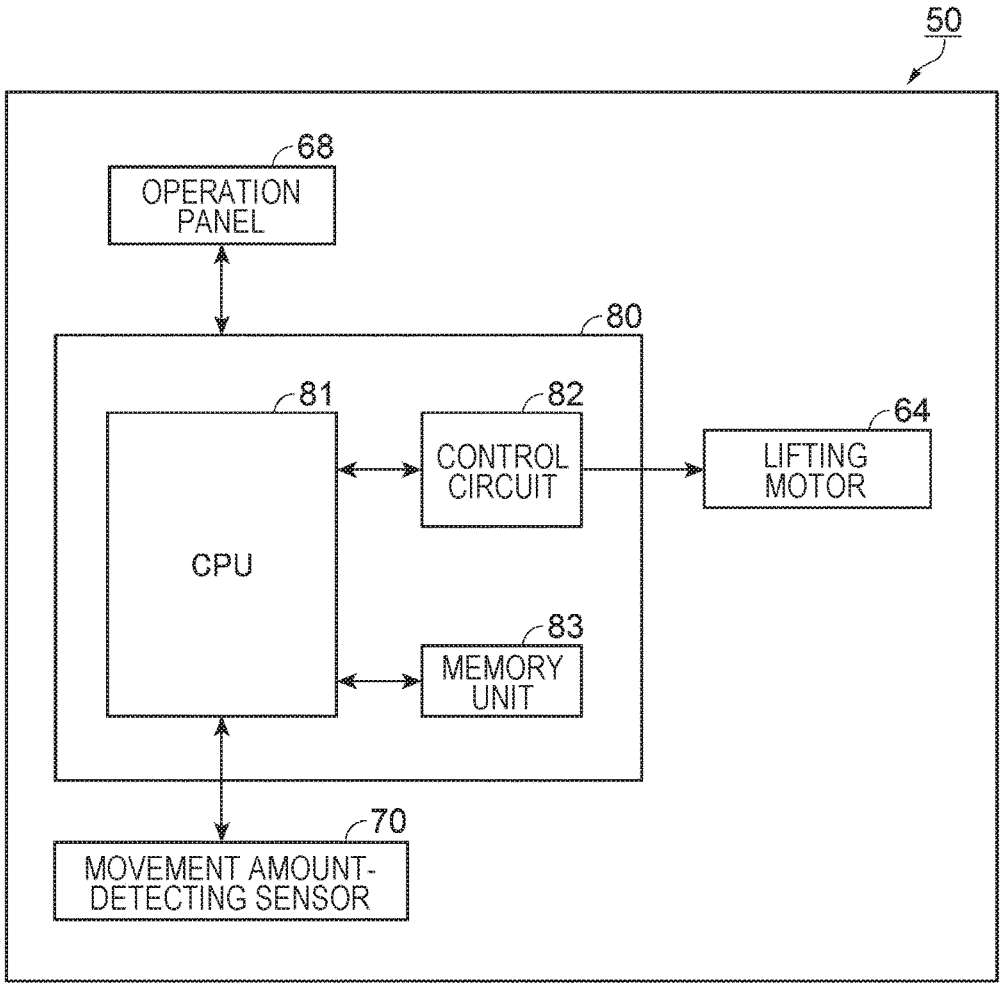
FIG. 4 is an electrical block diagram illustrating an electrical configuration of the stacking apparatus.

FIG. 4 is an electrical block diagram illustrating an electrical configuration of the stacking apparatus. The electrical configuration of the stacking apparatus 50 will be described with reference to FIG. 4.

The controller 80 is a control unit that controls the stacking apparatus 50. The controller 80 is configured to include a central processing unit (CPU) 81, a control circuit 82 and a memory unit 83. The CPU 81 is an arithmetic processing unit that controls processing for input signals from the movement amount-detecting sensor 70 and the entire stacking apparatus 50. The controller 80 controls each part of the stacking apparatus 50 in accordance with a command that has been input from the operation panel 68. In addition, the controller 80 displays a state of the stacking apparatus 50 on the operation panel 68.

The memory unit 83 secures an area to store programs or a work area of the CPU 81 and includes memory elements such as a random access memory (RAM), an electrically erasable programmable read-only memory (EEPROM), or the like. The memory unit 83 stores the image data captured by the movement amount-detecting sensor 70.

The CPU 81 controls the lifting motor 64 that lifts the urging unit 65 which presses the sheet S against the guiding part 51*a*, through the control circuit 82.

Stacking Method

Figure 5:
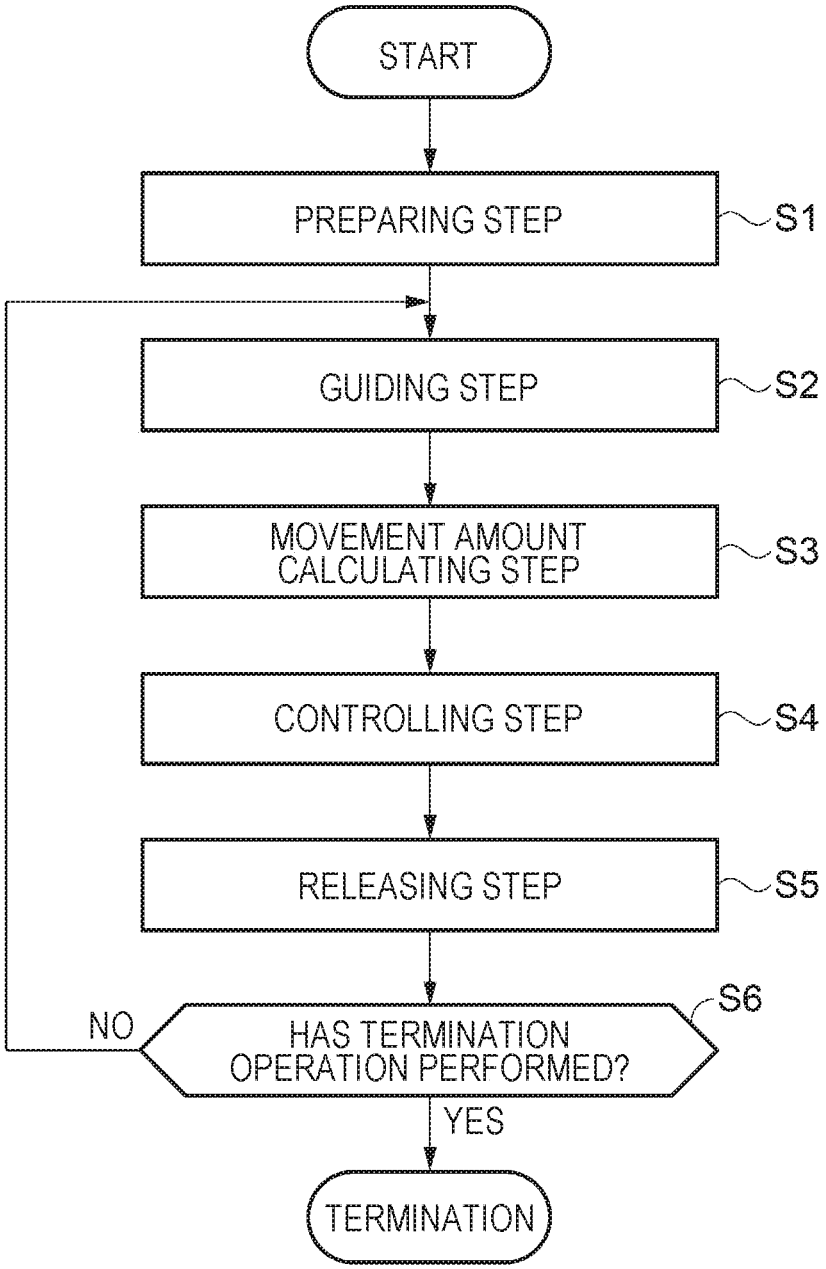
FIG. 5 is a flow chart illustrating a stacking method performed by the stacking apparatus.

FIG. 5 is a flow chart illustrating a stacking method performed by the stacking apparatus. FIGS. 6 to 10 are side views illustrating an operation of the stacking apparatus. A stacking method for the stacking apparatus 50 will be described with reference to FIGS. 4 to 10.

Step S1 is a preparing step. In the preparing step, information regarding a size of the sheet S (width in the x-axis direction and length in the y-axis direction) that is discharged from the recording apparatus 10 is input from the operation panel 68.

Figure 6:
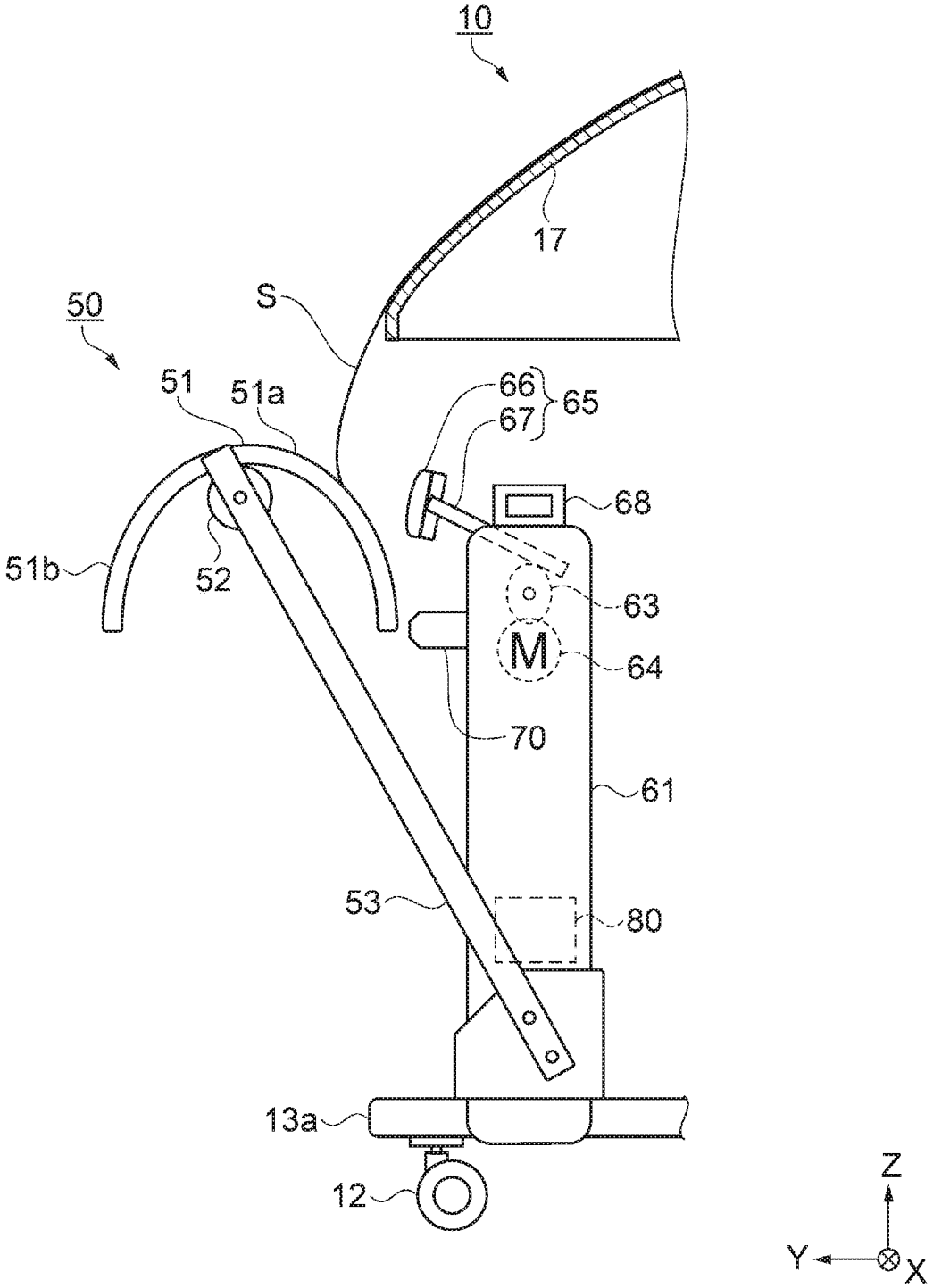
FIG. 6 is a side view illustrating an operation of the stacking apparatus.

Step S2 is a guiding step. FIG. 6 is a sectional view at a time when a leading end of the sheet S (an end on the downstream side in the transporting direction F) is in contact with the stacking member 51. In the guiding step, the sheet S as the recording medium that has been discharged from the recording apparatus 10 is guided in the direction approaching the recording apparatus 10. In other words, the stacking apparatus 50 is provided at a position where an orientation of the leading end of the sheet S is changed in the direction approaching the recording apparatus 10 at a time when the leading end of the sheet S that has been discharged from the recording apparatus 10 is in contact with the guiding part 51*a* of the stacking member 51 that curves so as to be convexed upward to peak at a point supported by the guide supporting unit 52.

Figure 7:
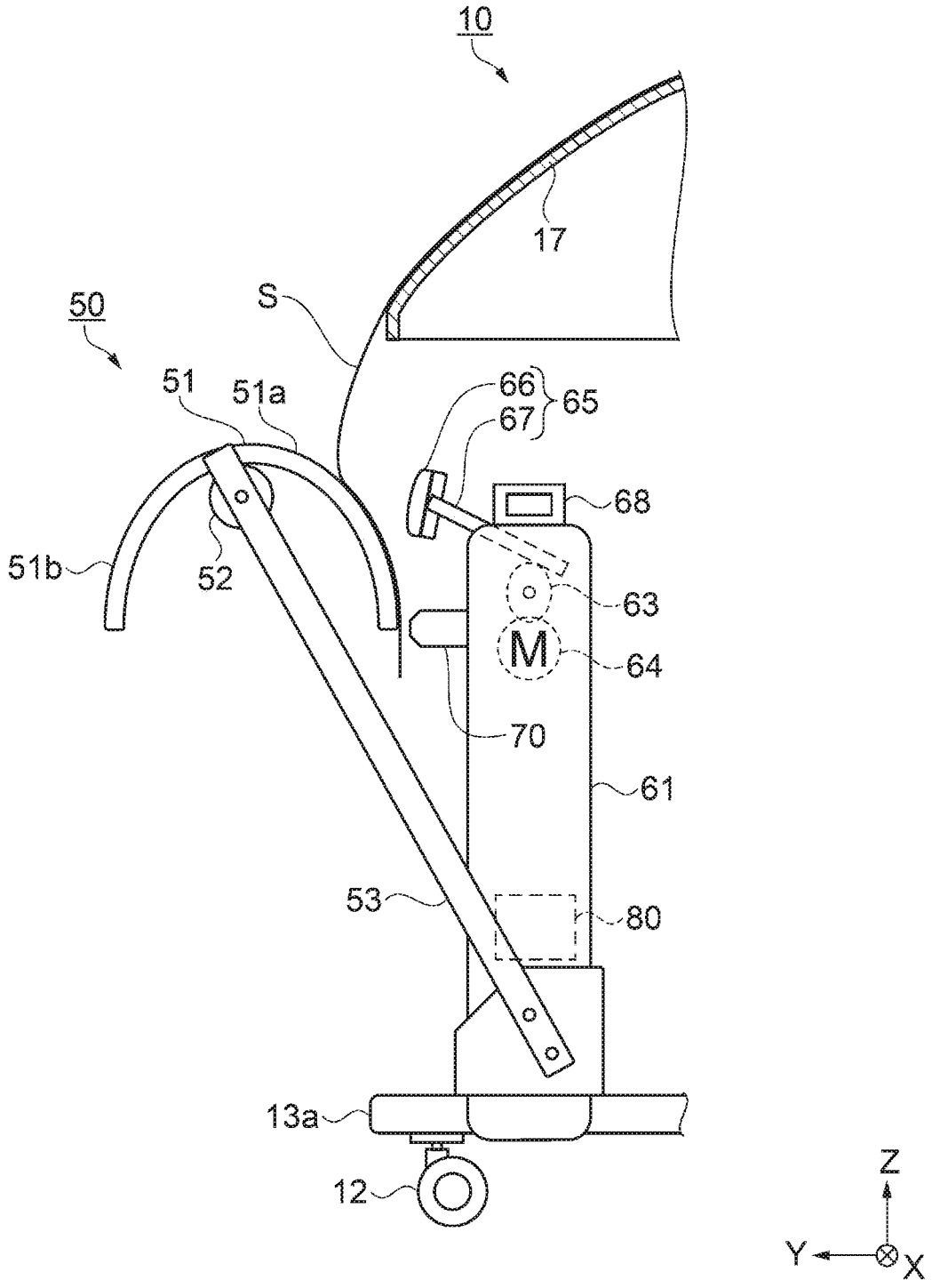
FIG. 7 is a side view illustrating the operation of the stacking apparatus.

Step S3 is a calculating step of a movement amount of the sheet S. FIG. 7 is a sectional view at a time when the sheet S has moved down toward the recording apparatus 10 along the guiding part 51*a* and has reached the movement amount-detecting sensor 70. The controller 80 controls the movement amount-detecting sensor 70 such that the surface of the sheet S is imaged at every predetermined time interval and then the captured image is stored in the memory unit 83. The controller 80 compares consecutive pieces of image data in a time series and acquires the movement amount of the sheet S for every predetermined time interval. Then, the controller 80 integrates the movement amounts for predetermined time intervals to acquire a total movement amount of the sheet S. In steps S1 to S3, the urging unit 65 remains stopped in a state of being raised.

Figure 8:
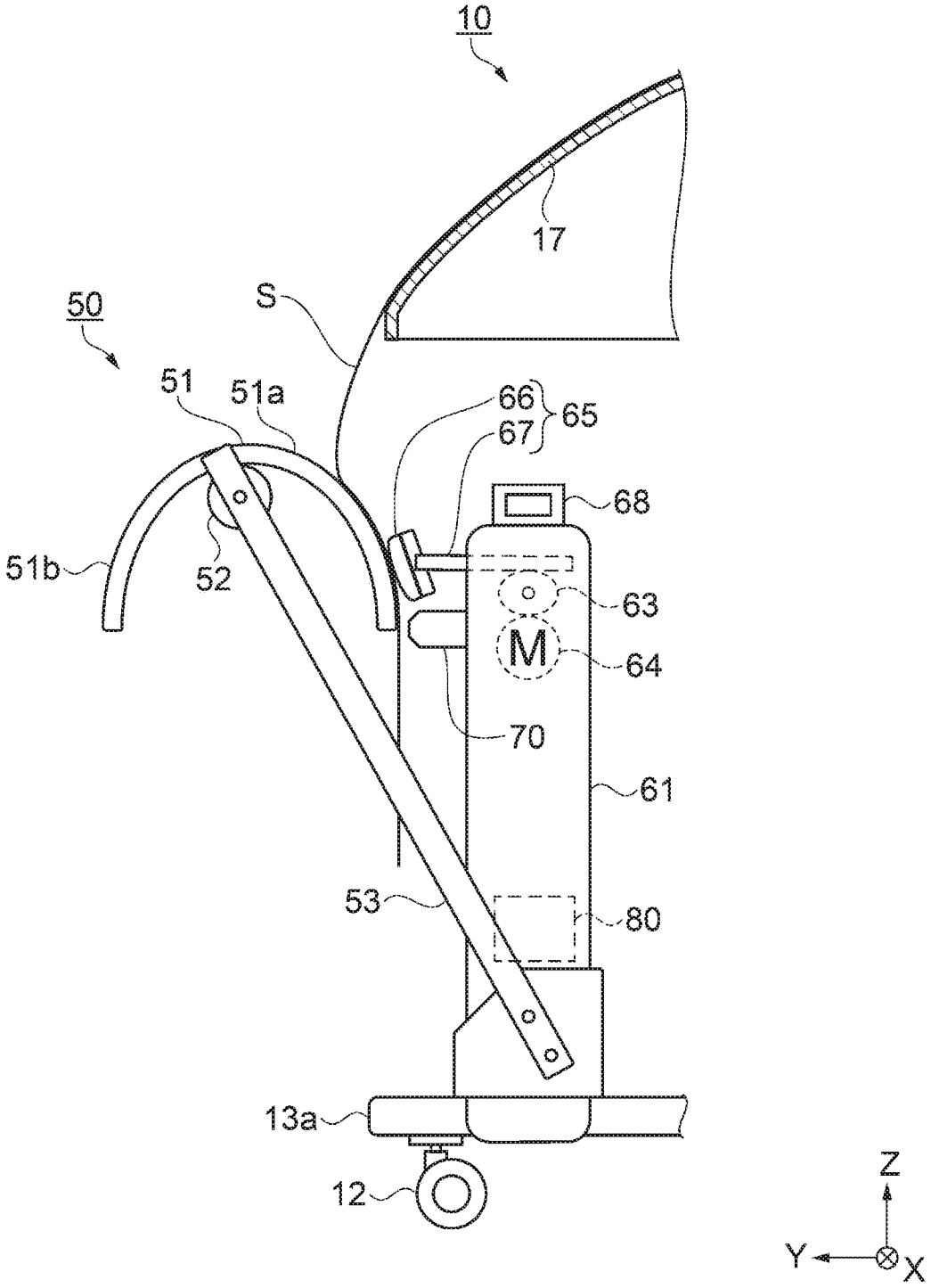
FIG. 8 is a side view illustrating the operation of the stacking apparatus.

Step S4 is a movement controlling step. FIG. 8 is sectional view at a time when a movement of the sheet S has been stopped. In the controlling step, the sheet S as the recording medium is guided in a direction away from the recording apparatus 10. The controller 80, based on the movement amount of the sheet S acquired in step S3, acquires a distance between the leading end of the sheet S and the top of the stacking member 51. The controller 80 drives the lifting motor 64 to rotate the cam 63, so that the urging unit 65 is lowered at a time when the leading end of the sheet S reaches a position at which the distance between the leading end of the sheet S and the top of the stacking member 51 is equal to approximately half the length of the sheet S, which is being discharged, in the y-axis direction. Accordingly, the sheet S is pressed by the urging unit 65 against the guiding part 51*a* and the sheet S is prevented from moving down toward the recording apparatus 10.

Figure 9:
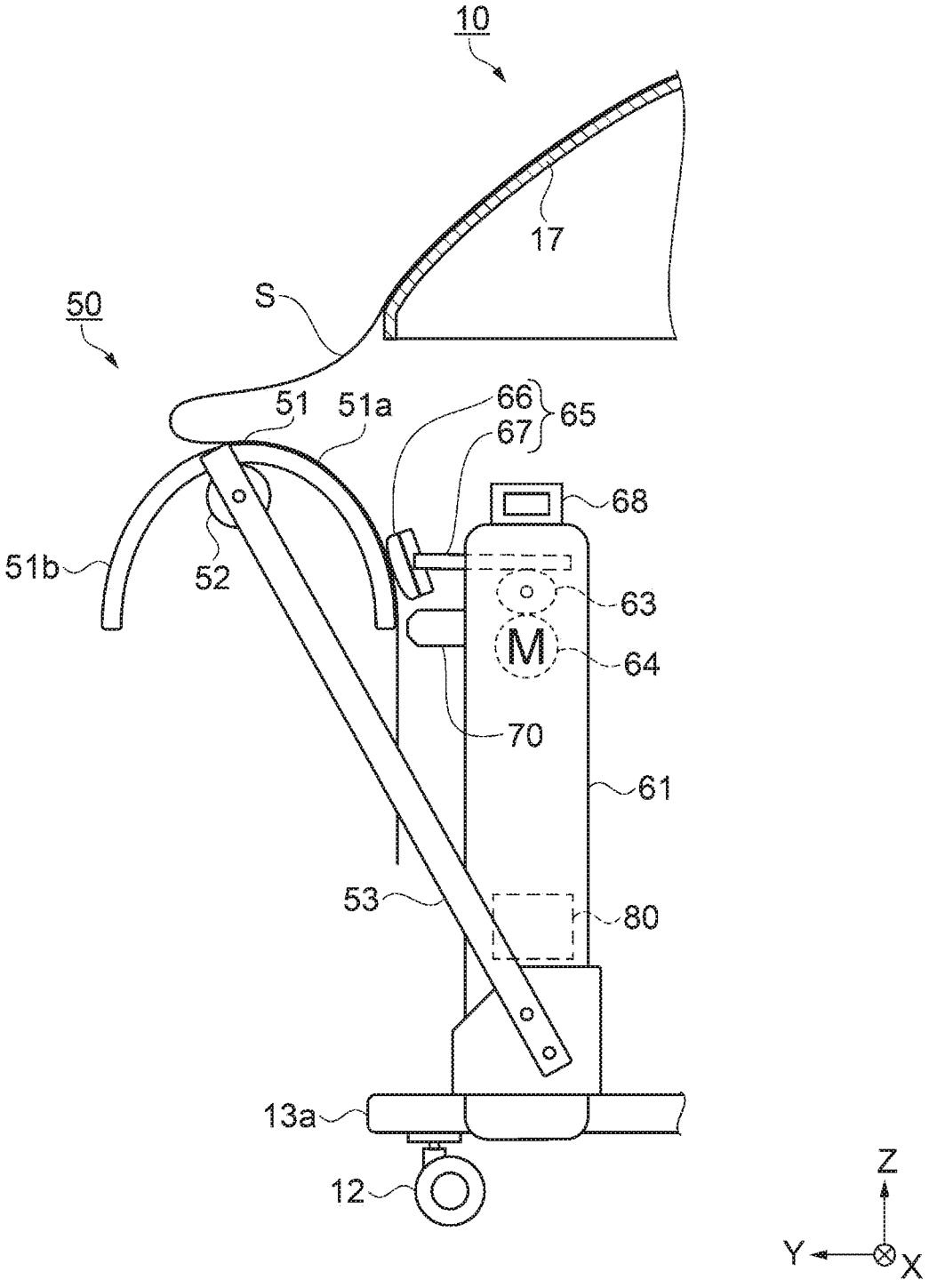
FIG. 9 is a side view illustrating the operation of the stacking apparatus.

FIG. 9 is a sectional view illustrating a state of the sheet S after the movement of the sheet S has been stopped. As illustrated in FIG. 9, once the sheet S is prevented from moving down toward the recording apparatus 10, the sheet S that is being discharged from the recording apparatus 10 is extruded in a U-shape along the shape of the stacking member 51, and is guided in the direction away from the recording apparatus 10.

Figure 10:
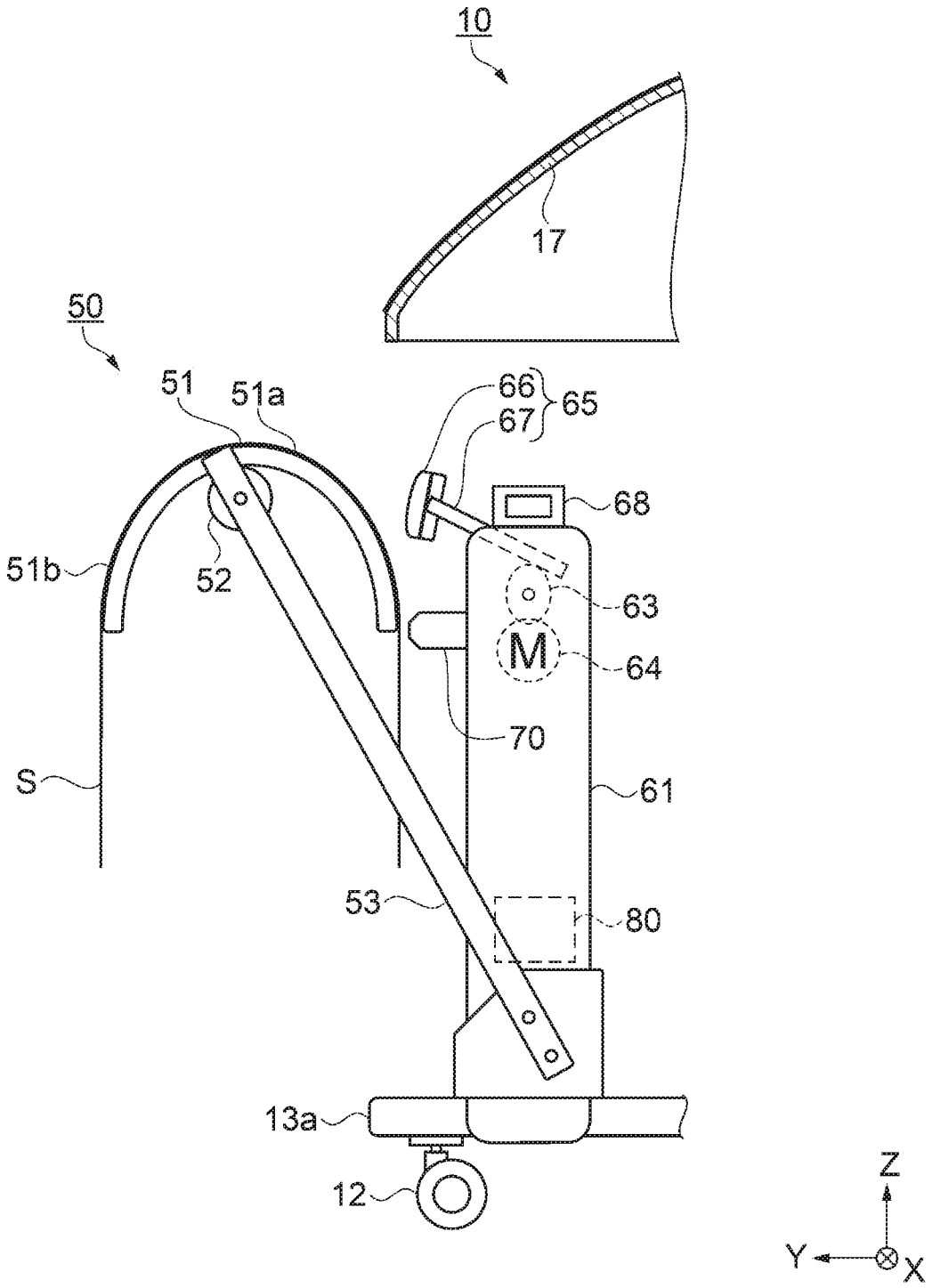
FIG. 10 is a side view illustrating the operation of the stacking apparatus.

Step S5 is a releasing step. FIG. 10 is a sectional view at a time when the sheet S is released. Once the recording of the image has been completed and the sheet S that has been cut in a predetermined size is discharged from the recording apparatus 10, a trailing end of the sheet S (an end on the upstream side in the transporting direction F) slips off along the guiding part 51*b* of the stacking member 51. Accordingly, the sheet S hangs down equally in the positive and negative directions of the y-axis at the midpoint, that is, the top of the stacking member 51, when seen from the side in the x-axis direction. The controller 80 calculates the time required for the trailing end of the sheet S to be discharged based on a sheet size and a moving speed of the sheet S acquired in step S3. Once the time required for the trailing end of the sheet S to be discharged from the recording apparatus 10 has passed, the controller 80 drives the lifting motor 64 and rotates the cam 63 to raise the urging unit 65.

Step S6 is a determining step. The controller 80 determines if a termination operation has been input from the operation panel 68. In a case where the termination operation has been input (step S6: Yes), the controller 80 terminates the operation thereof. In a case where the sheet S is being discharged in a size which is equal to the size of the sheet S that has been discharged immediately before without the termination operation being input (step S6: No), steps S2 to S6 are repeated, after going back to step S2.

The stacking apparatus 50 includes the guiding part 51*a* that guides the sheet S down toward the recording apparatus 10 and the urging unit 65 that controls the downward movement of the sheet S to guide the sheet S in the direction away from the recording apparatus 10 along the stacking member 51. Since the stacking apparatus 50 can be realized with a simple configuration in which the stacking member 51 and the urging unit 65 are included, the stacking apparatus 50 can be made small.

As described above, the following effects can be obtained with the stacking apparatus 50 and the stacking method according to the embodiment.

In the embodiment, the stacking apparatus 50 includes the guiding part 51*a* that guides the sheet S down in the direction approaching the recording apparatus 10 (one direction) from the top of the stacking member 51 on which the sheet S as the recording medium that is discharged from the recording apparatus 10 hangs down. The stacking apparatus 50 also includes the urging unit 65 that controls the downward movement of the sheet S to guide the sheet S in the direction away from the recording apparatus 10 (the other direction) by the stacking member 51. Accordingly, the stacking apparatus 50 holds the sheet S that has been discharged from the recording apparatus 10 in a state where the sheet S hangs down at the top of the stacking member 51 in the both directions. Since the stacking apparatus 50 can be realized with a simple configuration in which the stacking member 51 and the urging unit 65 are included, the size of the stacking apparatus 50 can be made small. As a result, it is possible to provide a small stacking apparatus 50.

Since the stacking apparatus 50 includes the guiding part 51*a* that guides the sheet S in the direction approaching the recording apparatus 10, it is possible to provide the urging unit 65 between the guiding part 51*a* and the recording apparatus 10. Accordingly, it is possible to reduce the size of the entire apparatus when the stacking apparatus 50 is mounted in the recording apparatus 10. Since the stacking apparatus 50 can be operated independently of the recording apparatus 10 by necessary information (the size of the sheet S or the like) being input, the stacking apparatus 50 can be mounted in various types of recording apparatuses.

Since the urging unit 65 presses the sheet S against the guiding part 51*a* at a position lower than the top of the stacking member 51, the urging unit 65 can be configured with a component with a small movable range. As a result, it is possible to configure a small stacking apparatus 50.

Since the stacking member 51 is shaped in an inverted catenary that curves so as to have a convex shape with the top as a center, the sheet S with a high rigidity and a small length can be held stably. It is also possible to ease the tendency for the sheet S to be folded by the weight the sheet S since the sheet S is held so as to hang down on the stacking member 51. In addition, the tendency for the sheet S to curl after being wound in a roll can be corrected as well.

In the embodiment, the stacking method includes the guiding step in which the leading end of the sheet S as the recording medium is guided toward the recording apparatus 10 along the guiding part 51*a*, and the controlling step in which the leading end of the sheet S is prevented from moving downward toward the recording apparatus 10 and the sheet S, which is discharged from the recording apparatus 10, is guided away from the recording apparatus 10 along the stacking member 51. These steps allow the sheet S that has been discharged from the recording apparatus 10 to be held in a state where the sheet S hangs down at the top of the stacking member 51 of the stacking apparatus 50 in both directions. Since the stacking method makes it possible for the stacking apparatus 50 to be realized with a simple configuration in which the stacking member 51 and the urging unit 65 are included, the stacking apparatus 50 can be made small. Accordingly, it is possible to provide the stacking method through which the size of the stacking apparatus 50 can be reduced.

Second Embodiment

Figure 11:
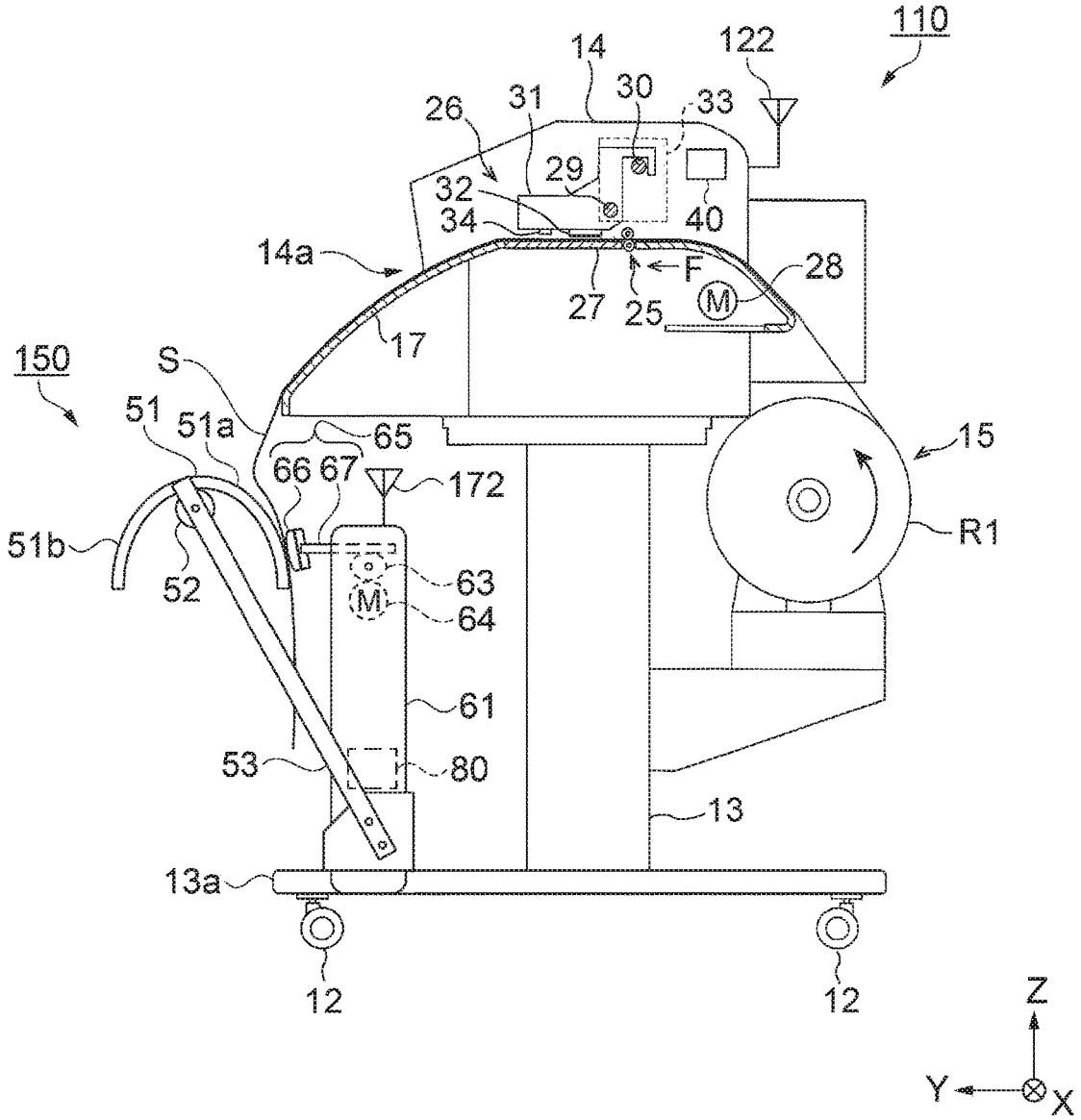
FIG. 11 is a side view of a stacking apparatus and a recording apparatus that discharges a recording medium to the stacking apparatus according to a second embodiment.
Figure 12:
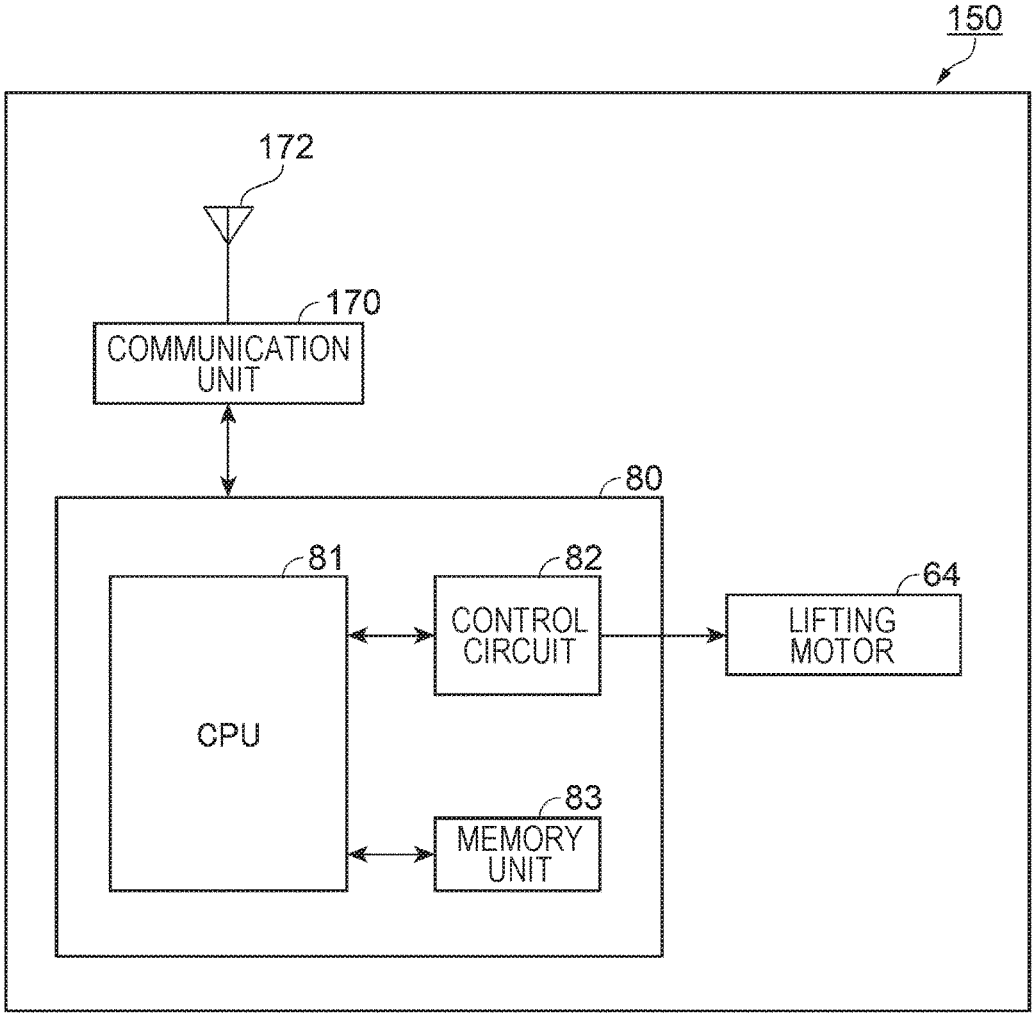
FIG. 12 is an electrical block diagram illustrating an electrical configuration of the stacking apparatus.
Figure 13:
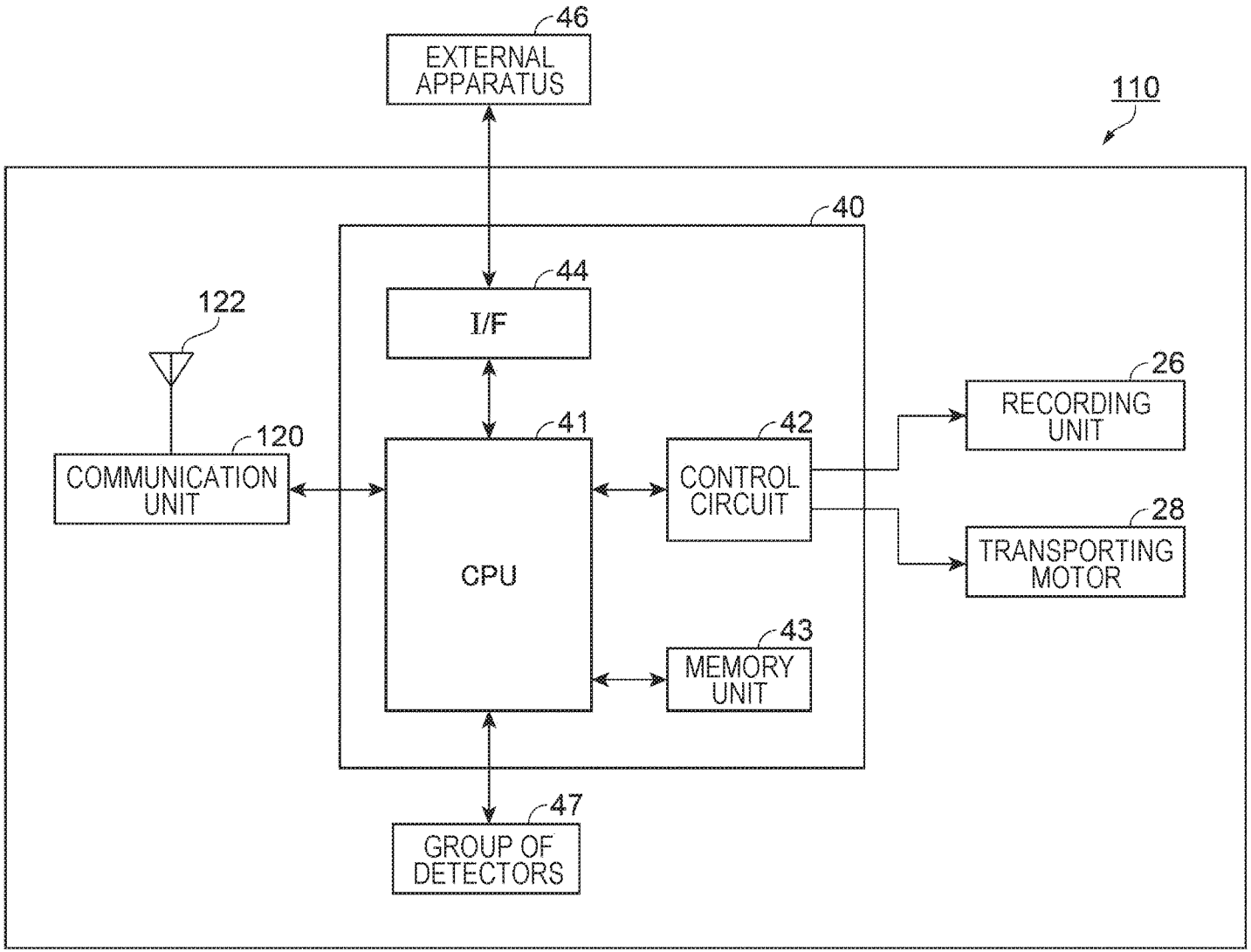
FIG. 13 is an electrical block diagram illustrating an electrical configuration of the recording apparatus.

FIG. 11 is a side view of a stacking apparatus and a recording apparatus that discharges a recording medium to the stacking apparatus according to a second embodiment. FIG. 12 is an electrical block diagram illustrating an electrical configuration of the stacking apparatus. FIG. 13 is an electrical block diagram illustrating an electrical configuration of the recording apparatus. A stacking apparatus 150 and a recording apparatus 110 that discharges a recording medium to the stacking apparatus 150 according to the embodiment will be described with reference to FIGS. 11 to 13. Parts that are included in the first embodiment will be denoted by the same reference numerals and the description thereof will not be repeated.

In the second embodiment, the stacking apparatus 150 is not provided with the operation panel 68 and the movement amount-detecting sensor 70 that are included in the stacking apparatus 50 described in the first embodiment. Instead, the stacking apparatus 150 includes a communication unit 170 and the recording apparatus 110 includes a communication unit 120.

The electrical configuration of the stacking apparatus 150 will be described with reference to FIGS. 11 and 12. The stacking apparatus 150 is provided with the communication unit 170 in which an antenna 172 for a wireless communication is included. The communication unit 170 wirelessly transmits and receives data to and from the recording apparatus 110.

Wireless communication can be achieved with methods including various types of wireless systems such as wireless LAN, Bluetooth (registered trademark), Zigbee (registered trademark), Worldwide Interoperability for Microwave Access (WiMAX), Personal Handy-phone System (PHS), specific low power, a mobile phone and the like.

Hereinafter, the electrical configuration of the recording apparatus 110 will be described with reference to FIGS. 11 and 13.

The recording apparatus 110 is provided with the controller 40. The controller 40 is a control unit that controls the recording apparatus 110. The controller 40 is configured to include a control circuit 42, an interface unit (I/F) 44, a central processing unit (CPU) 41 and a memory unit 43. The interface unit 44 is used for transmitting and receiving data between the recording apparatus 110 and an external apparatus 46 that deals with images, such as a computer, a digital camera and the like. The CPU 41 is an arithmetic processing unit that controls processing for input signals from a group of various detectors 47 and the entire recording apparatus 110.

The memory unit 43 secures an area to store programs or a work area of the CPU 41 and includes memory elements such as a random access memory (RAM), an electrically erasable programmable read-only memory (EEPROM), or the like.

The CPU 41 controls the transporting motor 28 that drives the pair of transporting rollers 25 which transports the sheet S, the recording unit 26 that ejects ink toward the sheet S while moving the carriage 31 in a direction (x-axis direction) that intersects with the transporting direction F (y-axis direction) and other parts not illustrated in the drawings, through the control circuit 42.

The recording apparatus 110 is provided with the communication unit 120 in which an antenna 122 for wireless communication is included. The communication unit 120 wirelessly transmits and receives data to and from the stacking apparatus 150. The same wireless systems as in the stacking apparatus 150 can be used as a communication method.

Stacking Method

Figure 14:
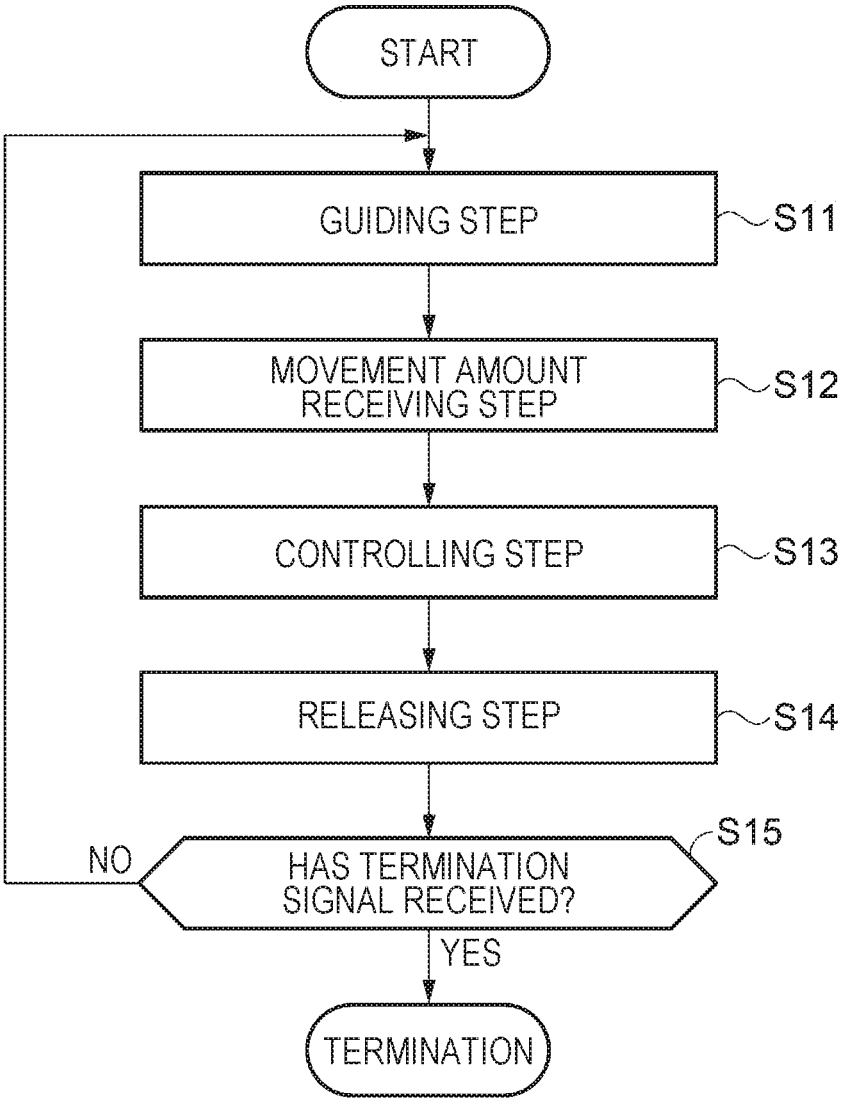
FIG. 14 is a flow chart illustrating a stacking method performed by the stacking apparatus.

FIG. 14 is a flow chart illustrating a stacking method performed by a stacking apparatus. A stacking method for the stacking apparatus 150 will be described with reference to FIG. 14.

Step S11 is a guiding step. In the guiding step, the sheet S as the recording medium that has been discharged from the recording apparatus 110 is guided in a direction approaching the recording apparatus 110. In other words, the stacking apparatus 150 is provided at a position where an orientation of the leading end of the sheet S is changed in the direction approaching the recording apparatus 110 at a time when the leading end of the sheet S that has been discharged from the recording apparatus 110 is in contact with the guiding part 51*a* of the stacking member 51 that curves so as to have a convex shape with the top as a center.

Step S12 is a receiving step of a movement amount of the sheet S. The controller 40 for the recording apparatus 110 controls driving of the transporting motor 28 through the control circuit 42 to rotate the pair of transporting rollers 25 and to transport the sheet S in the transporting direction F. Then, the controller 40 transmits, as transportation data, a transported amount of the sheet S calculated based on a rotation amount of the transporting motor 28 sequentially to the communication unit 120, to begin with. In addition, the controller 40 appropriately transmits data such as information on a state of printing onto the sheet S to the communication unit 120 first.

The controller 80 for the stacking apparatus 150 receives transportation data related to the sheet S that is being transmitted from the recording apparatus 110. From steps S11 to S12, the urging unit 65 remains stopped in a state of being raised.

Step S13 is a controlling step. In the controlling step, the sheet S as the recording medium is guided in a direction away from the recording apparatus 110. The controller 80, based on the movement amount of the sheet S acquired in step S12, acquires a distance between the leading end of the sheet S and the top of the stacking member 51. The controller 80 drives the lifting motor 64 to rotate the cam 63, so that the urging unit 65 is lowered at a time when the leading end of the sheet S reaches a position at which the distance between the leading end of the sheet S and the top of the stacking member 51 is equal to approximately half the length of the sheet S, which is being discharged, in the y-axis direction. Accordingly, the sheet S is pressed by the urging unit 65 against the guiding part 51*a* and the sheet S is prevented from moving down toward the recording apparatus 110. Once the sheet S is prevented from moving down toward the recording apparatus 110, the sheet S that is being discharged from the recording apparatus 110 is extruded in a U-shape along the shape of the stacking member 51, and is guided in the direction away from the recording apparatus 110. Information of the length of the sheet S in the y-axis direction is transmitted from the recording apparatus 110 by step S12, and is stored in the memory unit 83 in advance. Since it takes time for the sheet S that is discharged from the recording apparatus 110 to reach the stacking member 51 after the controller 40 for the recording apparatus 110 transmits the transported amount of the sheet S as the transportation data calculated based on the rotation amount of the transporting motor 28 to the communication unit 120 to begin with, the controller 80 controls the urging unit 65 given the time taken from the calculation of the transported amount of the sheet S to the arrival of the sheet S at the stacking member 51.

Step S14 is a releasing step. Once the recording of the image has been completed and the sheet S that has been cut in a predetermined size is discharged from the recording apparatus 110, the trailing end of the sheet S slips off along the guiding part 51*b* of the stacking member 51. Accordingly, the sheet S hangs down equally in the positive and negative directions of the y-axis at the midpoint, that is, the top of the stacking member 51, when seen from the side in the x-axis direction. The controller 80 drives the lifting motor 64 and rotates the cam 63 to raise the urging unit 65 based on data on a state of printing onto the sheet S (for example, cutting termination data of the sheet S).

Step S15 is a determining step. The controller 80 determines if data on printing operation termination has been received from the recording apparatus 110. In a case where a signal for printing operation termination has been received (step S15: Yes), the controller 80 terminates the operation of the stacking apparatus 150. In a case where the signal for printing operation termination has not been received (step S15: No), steps S11 to S14 are repeated, after going back to step S11.

In the embodiment, it is described that the stacking apparatus 150 and the recording apparatus 110 wirelessly communicate with each other. Without being limited thereto, however, the stacking apparatus 150 and the recording apparatus 110 may conduct wired communication by being connected through wires such as Universal Serial Bus (USB), Ethernet (registered trademark), or the like.

As described above, the following effects can be obtained with the recording apparatus 110 according to the embodiment.

The stacking apparatus 150 is provided with the communication unit 170 that receives the transportation data on the sheet S transmitted from the recording apparatus 110 or various types of data related to printing. Based on the data, the lifting motor 64 is controlled to lift the urging unit 65. As a result, it is possible to stack the sheet S that is discharged from the recording apparatus 110 on the stacking member 51. Accordingly, the movement amount-detecting sensor 70 for calculating the movement amount of the sheet S and the operation panel 68 provided in the first embodiment are unnecessary in the second embodiment, and it becomes possible to configure an even smaller and more affordable stacking apparatus 150.

Third Embodiment

Figure 15:
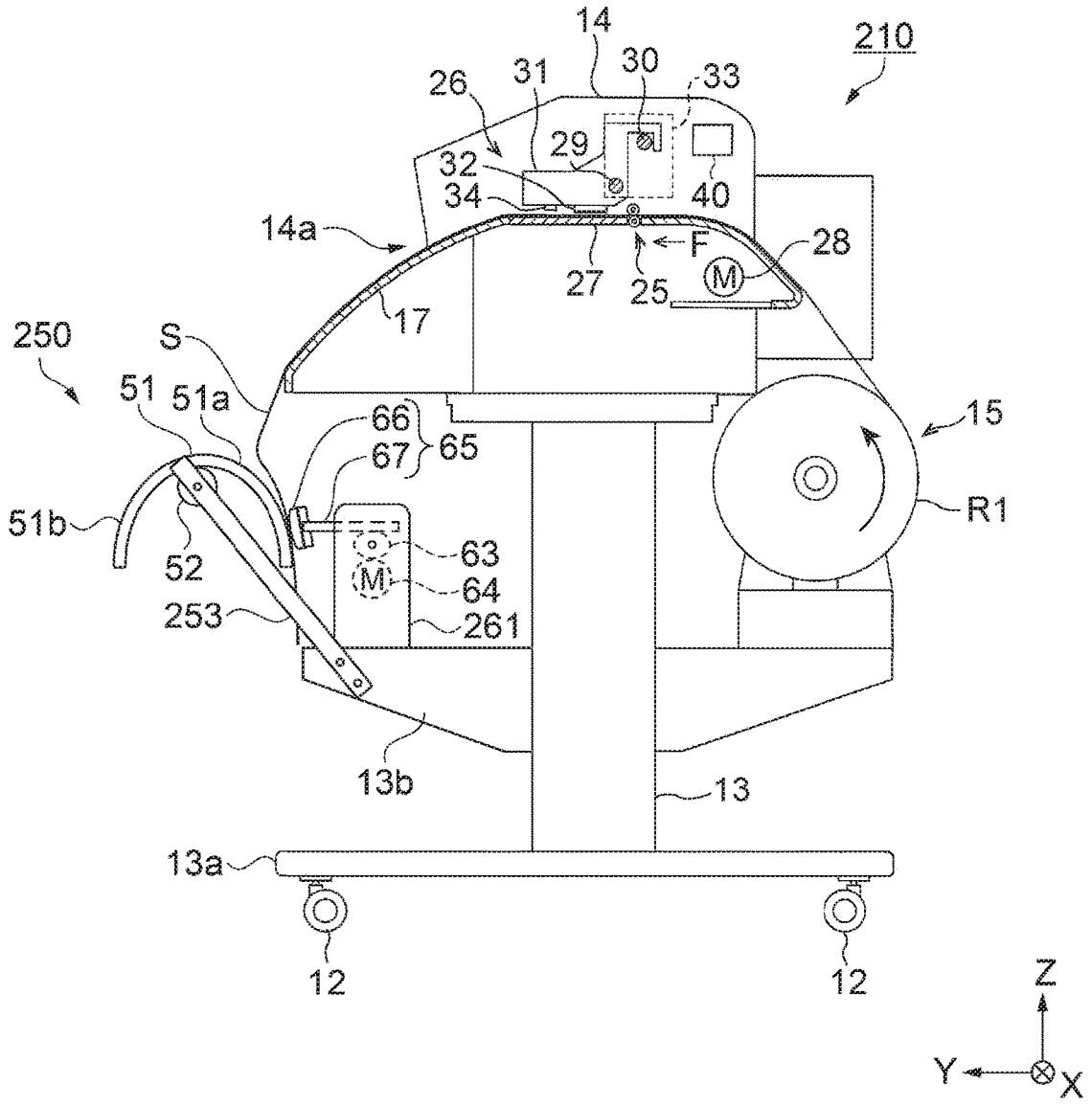
FIG. 15 is a partial sectional view of a recording apparatus according to a third embodiment.
Figure 16:
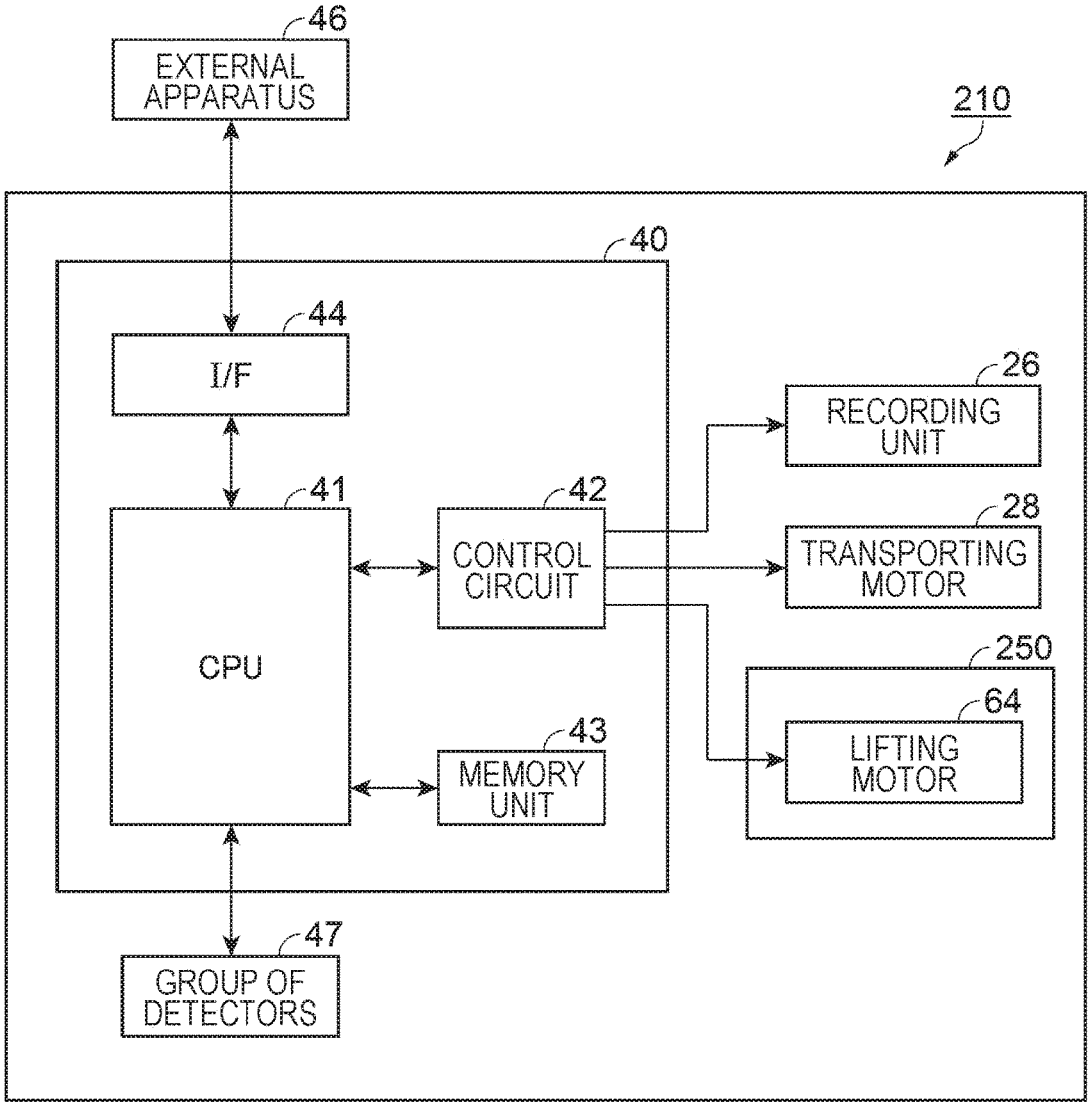
FIG. 16 is an electrical block diagram illustrating an electrical configuration of the recording apparatus.

FIG. 15 is a partial sectional view of a recording apparatus according to a third embodiment. FIG. 16 is an electrical block diagram illustrating an electrical configuration of the recording apparatus. A recording apparatus 210 according to the embodiment will be described with reference to FIGS. 15 and 16. In the third embodiment, the recording apparatus 210 is configured to include and be integrated with a stacking apparatus 250. Parts that are included in the first and second embodiments will be denoted by the same reference numerals and the description thereof will not be repeated.

As illustrated in FIG. 15, the recording apparatus 210 includes the stacking apparatus 250 that is supported by a pair of supporting portions 13*b* which extend from the pair of legs 13 toward the discharging port 14*a* (positive direction of the y-axis) from which the sheet S is discharged. On the pair of supporting portions 13*b*, a pair of stacking unit housings 261 of the stacking apparatus 250 are provided, and a pair of arm members 253 extend from the pair of supporting portions 13*b*. The guide supporting unit 52 is provided on tips of the pair of arm members 253 and supports the stacking member 51. In one of the stacking unit housings 261, the cam 63 that lifts the urging unit 65 and the lifting motor 64 that rotates the cam 63 are provided.

As shown in FIG. 16, the controller 40 controls the stacking apparatus 250. Specifically, the CPU 41 controls, through the control circuit 42, the lifting motor 64 that lifts the urging unit 65 which presses the sheet S against the guiding part 51*a*.

Stacking Method

Figure 17:
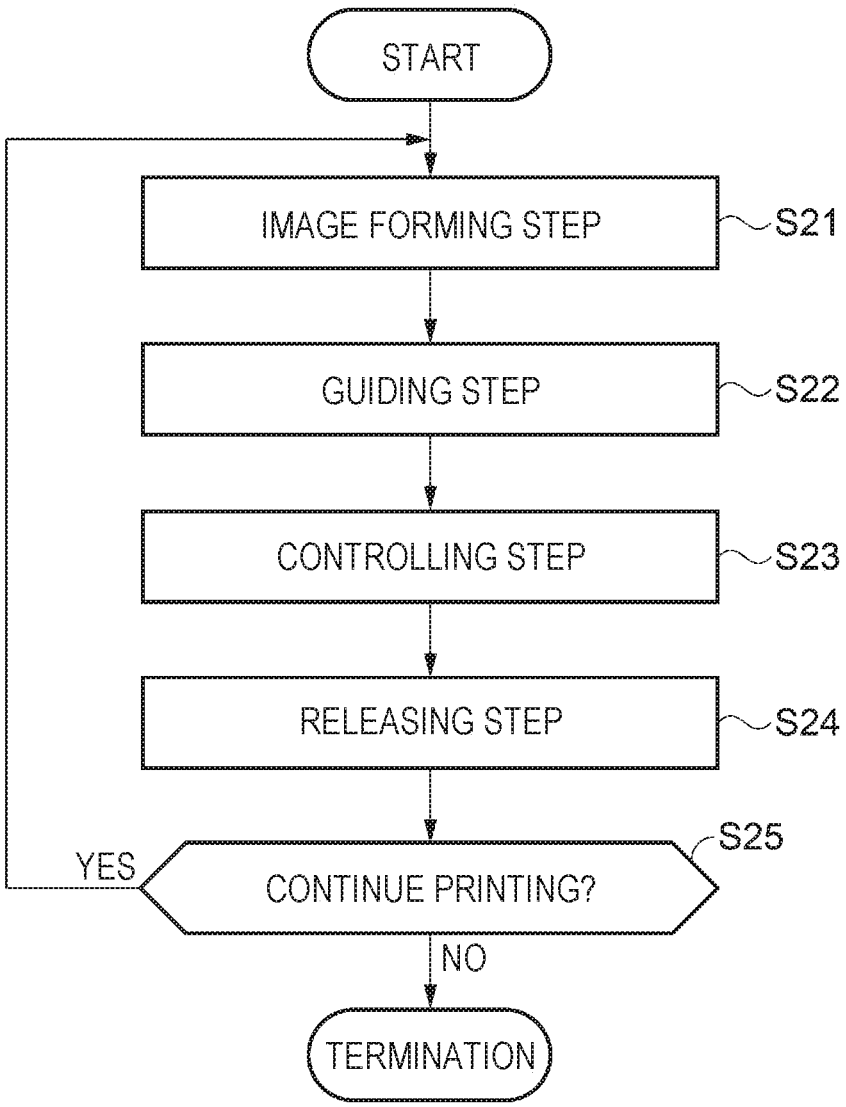
FIG. 17 is a flow chart illustrating a stacking method performed by the recording apparatus.

FIG. 17 is a flow chart illustrating a stacking method performed by the recording apparatus. The stacking method for the recording apparatus 210 will be described with reference to FIGS. 16 and 17.

Step S21 is an image forming step. The controller 40 controls each part that configures the transporting motor 28 or the recording unit 26, and forms an image or like onto the sheet S by repeating the transportation of the sheet S and the ejection of ink.

Step S22 is a guiding step. In the guiding step, the sheet S as the recording medium that has been discharged from the discharging port 14*a* is guided in the direction approaching the recording apparatus 210. In other words, the stacking apparatus 250 that is built in the recording apparatus 210 is provided at a position where an orientation of the leading end of the sheet S is changed in the direction approaching the main body of the recording apparatus 210 from the stacking apparatus 250 at a time when the leading end of the sheet S that has been discharged from the recording apparatus 210 is in contact with the guiding part 51*a* of the stacking member 51 that curves so as to have a convex shape with the top as a center.

Step S23 is a controlling step. In the controlling step, the sheet S as the recording medium is guided in a direction away from the recording apparatus 210. The controller 40 calculates the transported amount of the sheet S based on the rotation amount of the transporting motor 28 and acquires a distance between the leading end of the sheet S and the top of the stacking member 51 based on the movement amount of the sheet S. The controller 40 drives the lifting motor 64 to rotate the cam 63, so that the urging unit 65 is lowered at a time when the leading end of the sheet S reaches a position at which the distance between the leading end of the sheet S and the top of the stacking member 51 is equal to approximately half the length of the sheet S, which is being discharged, in the y-axis direction. Accordingly, the sheet S is pressed by the urging unit 65 against the guiding part 51*a*, and the sheet S is prevented from moving down toward the main body of the recording apparatus 210. Once the sheet S is prevented from moving down toward the main body of the recording apparatus 210, the sheet S that is being discharged from the discharging port 14*a* is extruded in a U-shape along the shape of the stacking member 51, and is guided in the direction away from the recording apparatus 210. Since it takes time for the sheet S that is discharged from the recording apparatus 210 to reach the stacking member 51 after the controller 40 calculates the transported amount of the sheet S based on the rotation amount of the transporting motor 28, the controller 40 controls the urging unit 65 given the time taken from the calculation of the transported amount of the sheet S to the arrival of the sheet S at the stacking member 51.

Step S24 is a releasing step. Once the recording of the image has been completed, the controller 40 controls a cutter (not shown) such that the sheet S is cut in a predetermined size and then the sheet S is discharged from the discharging port 14*a*. Then, the trailing end of the sheet S slips off along the guiding part 51*b* of the stacking member 51. Accordingly, the sheet S hangs down equally in the positive and negative directions of the y-axis at the midpoint, that is, the top of the stacking member 51, when seen from the side in the x-axis direction. After the sheet S has been cut, the controller 40 controls the lifting motor 64 and rotates the cam 63 to raise the urging unit 65.

Step S25 is a determining step. The controller 40 determines whether to continue printing or not. In a case where it is determined to continue printing (step S25: Yes), steps S21 to S24 are repeated, after going back to step S21. Accordingly, the sheet S is stacked and held on the stacking member 51. In a case where it is determined not to continue printing (step S25: No), the controller 40 terminates the operation of the recording apparatus 210.

As described above, the following effect can be obtained with the recording apparatus 210 according to the embodiment.

Since the recording apparatus 210 is provided with the stacking apparatus 250 that has been made smaller by the use of the aforementioned stacking method, it is possible to provide a small recording apparatus 210 that has a stack function.

This application claims priority under 35 U.S.C. § 119 to Japanese Patent Application No. 2015-161675, filed Aug. 19, 2015. The entire disclosure of Japanese Patent Application No. 2015-161675 is hereby incorporated herein by reference.

What is claimed is:

1. A stacking apparatus comprising:

a stacking member that stacks a recording medium discharged from a recording apparatus such that the recording medium hangs on the stacking member;

a guiding part that is a part of the stacking member and guides the recording medium down to a point lower than a top of the stacking member;

an urging unit that controls movement of the recording medium; and a movement-amount detecting sensor that detects a movement amount of the recording medium as the recording medium moves along the guiding part, the movement-amount detecting sensor being positioned downstream of the urging unit, the guiding part guiding the recording medium toward the movement-amount detecting sensor.

2. The stacking apparatus according to claim 1, wherein the guiding part guides the recording medium toward the recording apparatus.

3. The stacking apparatus according to claim 1, wherein the stacking member has a convex shape with the top at a center.

4. The stacking apparatus according to claim 1, wherein the urging unit controls the movement of the recording medium by pressing the recording medium against the guiding part.

5. The stacking apparatus according to claim 1, wherein the urging unit presses the recording medium against the guiding part at a position lower than the top of the stacking member.

6. A recording apparatus comprising the stacking apparatus according to claim 1.

7. A stacking method performed by a stacking apparatus including a stacking member that stacks a recording medium discharged from a recording apparatus such that the recording medium hangs on the stacking member, a guiding part that is a part of the stacking member and guides the recording medium down to a point lower than a top of the stacking member, and an urging unit that controls movement of the recording medium, the stacking method comprising:

guiding the recording medium down to the point lower than the top of the stacking member;

detecting a movement amount of the recording medium with a movement-amount detector disposed downstream of the urging unit, the guiding part guiding the recording medium toward the movement-amount detecting sensor; and controlling the movement of the recording medium, wherein in the guiding of the recording medium, the recording medium is guided toward the recording apparatus, and wherein in the controlling of the movement of the recording medium, the recording medium is guided away from the recording apparatus.

8. The stacking apparatus of claim 1, wherein the movement-amount detector is arranged at a position to face the guiding part.

9. The stacking apparatus of claim 1, wherein the movement-amount detector and the urging unit cooperate to stack the medium on the stacking unit.

10. The stacking apparatus of claim 1, wherein the urging unit is raised when the medium is guided towards the apparatus and when the movement amount detector detects distance of approximately one-half of a length of a sheet of a medium, the urging unit is lowered to press against the medium such that the medium is guided away from the apparatus and stacked on the stacking unit.

11. The stacking apparatus of claim 1, wherein the movement-amount detecting sensor is an optical sensor configured to detect an image on the recording medium.

12. The stacking apparatus of claim 1, wherein the movement-amount detecting sensor outputs image data captured by the movement-amount detecting sensor, a controller communicating with the movement-amount detecting sensor integrates a movement amount of the recording medium from the output image data.

13. The stacking apparatus of claim 12, wherein the controller compares consecutive pieces of image data in a time series received from the movement-amount detecting sensor.

14. The stacking apparatus of claim 1, wherein the movement-amount detecting sensor comprises a light emitting unit configured to emit light and an imaging element configured to receive the light reflected from the recording medium.

* * * * *